US009359158B2

(12) United States Patent
Hino et al.

(10) Patent No.: US 9,359,158 B2
(45) Date of Patent: Jun. 7, 2016

(54) SHEET FEEDING DEVICE, IMAGE FORMING APPARATUS, AND IMAGE FORMING SYSTEM

(71) Applicants: Yasunori Hino, Kanagawa (JP); Chikara Akata, Kanagawa (JP); Tomoki Tamate, Kanagawa (JP); Hideaki Takahashi, Kanagawa (JP); Munehisa Fuda, Kanagawa (JP); Toshihiro Okutsu, Kanagawa (JP); Takashi Fukumoto, Kanagawa (JP); Yasuo Niikura, Kanagawa (JP); Masaki Ishizaki, Kanagawa (JP); Kiyotake Nakamura, Kanagawa (JP); Hidetoshi Kojima, Kanagawa (JP); Hisayoshi Sugawara, Kanagawa (JP); Kazunori Konno, Kanagawa (JP); Tatsuya Sugawara, Kanagawa (JP); Kohjiroh Haga, Kanagawa (JP); Masato Hashimoto, Kanagawa (JP)

(72) Inventors: Yasunori Hino, Kanagawa (JP); Chikara Akata, Kanagawa (JP); Tomoki Tamate, Kanagawa (JP); Hideaki Takahashi, Kanagawa (JP); Munehisa Fuda, Kanagawa (JP); Toshihiro Okutsu, Kanagawa (JP); Takashi Fukumoto, Kanagawa (JP); Yasuo Niikura, Kanagawa (JP); Masaki Ishizaki, Kanagawa (JP); Kiyotake Nakamura, Kanagawa (JP); Hidetoshi Kojima, Kanagawa (JP); Hisayoshi Sugawara, Kanagawa (JP); Kazunori Konno, Kanagawa (JP); Tatsuya Sugawara, Kanagawa (JP); Kohjiroh Haga, Kanagawa (JP); Masato Hashimoto, Kanagawa (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/567,421

(22) Filed: Dec. 11, 2014

(65) Prior Publication Data

US 2015/0166280 A1 Jun. 18, 2015

(30) Foreign Application Priority Data

Dec. 16, 2013 (JP) ..... 2013-259325
Sep. 16, 2014 (JP) ..... 2014-187318

(51) Int. Cl.
*B65H 1/04* (2006.01)
*B65H 7/14* (2006.01)
(Continued)

(52) U.S. Cl.
CPC .. *B65H 7/14* (2013.01); *B65H 1/04* (2013.01); *B65H 1/14* (2013.01); *B65H 1/266* (2013.01);
(Continued)

(58) Field of Classification Search
CPC ..... B65H 3/48; B65H 7/16; B65H 2515/212
USPC ..... 271/97, 105
See application file for complete search history.

(56) References Cited

U.S. PATENT DOCUMENTS 5,645,274 A 7/1997 Ubayashi et al.
8,205,872 B2 6/2012 Yamauchi et al.
(Continued)

FOREIGN PATENT DOCUMENTS

JP S60-81953 A 5/1985
JP S62-60727 A 3/1987
(Continued)

*Primary Examiner* — Jeremy R Severson
(74) *Attorney, Agent, or Firm* — Harness, Dickey & Pierce PLC

(57) ABSTRACT

A sheet feeding device includes: a sheet stacking member; an air blowing unit configured to blow air onto the sheet bundle placed on the sheet stacking member to suspend multiple sheets of the sheet bundle; a lifting/lowering unit configured to lift/lower the sheet stacking member; an optical reflection sensor configured to detect a suspended sheet suspended by the air blowing unit; and a control unit configured to control the lifting/lowering unit based on an output value of the optical reflection sensor. The optical reflection sensor is configured to be capable of detecting an area corresponding to multiple sheets in a sheet suspension zone extending between a non-suspended sheet bundle and a conveying member configured to convey an uppermost sheet of the multiple suspended sheets. The non-suspended sheet bundle is made up of sheets not suspended during a period when air is blown by the air blowing unit.

20 Claims, 11 Drawing Sheets

(51) Int. Cl.

| | |
|---|---|
| ***B65H 3/14*** | (2006.01) |
| ***B65H 1/14*** | (2006.01) |
| ***B65H 7/16*** | (2006.01) |
| ***B65H 7/20*** | (2006.01) |
| ***B65H 1/26*** | (2006.01) |
| ***B65H 3/12*** | (2006.01) |
| ***B65H 3/48*** | (2006.01) |
| ***B65H 7/04*** | (2006.01) |

(52) U.S. Cl.

CPC ..... *B65H 3/128* (2013.01); *B65H 3/14* (2013.01); *B65H 3/48* (2013.01); *B65H 7/04* (2013.01); *B65H 7/16* (2013.01); *B65H 7/20* (2013.01); *B65H 2405/15* (2013.01); *B65H 2405/312* (2013.01); *B65H 2405/332* (2013.01); *B65H 2511/20* (2013.01); *B65H 2511/30* (2013.01); *B65H 2511/416* (2013.01); *B65H 2513/40* (2013.01); *B65H 2553/416* (2013.01); *B65H 2553/81* (2013.01); *B65H 2553/822* (2013.01); *B65H 2701/1311* (2013.01); *B65H 2801/06* (2013.01)

(56) References Cited

U.S. PATENT DOCUMENTS

| | | | | |
|---|---|---|---|---|
| 8,336,870 | B2 * | 12/2012 | Kobayashi | 271/10.01 |
| 8,485,517 | B2 * | 7/2013 | Clark et al. | 271/105 |
| 8,797,607 | B2 * | 8/2014 | Hayashihara et al. | 358/449 |
| 2008/0297580 | A1 | 12/2008 | Fukumoto et al. | |
| 2009/0014948 | A1 | 1/2009 | Takahashi | |
| 2010/0148419 | A1 * | 6/2010 | Suzuki | 271/3.11 |
| 2010/0148430 | A1 | 6/2010 | Fuda | |
| 2011/0148027 | A1 | 6/2011 | Fuda | |
| 2011/0187042 | A1 | 8/2011 | Fuda | |
| 2011/0187044 | A1 | 8/2011 | Utagawa et al. | |
| 2011/0193284 | A1 | 8/2011 | Fuda | |
| 2011/0221119 | A1 | 9/2011 | Fuda | |
| 2011/0301005 | A1 | 12/2011 | Hattori et al. | |
| 2012/0133092 | A1 | 5/2012 | Fuda et al. | |
| 2012/0153560 | A1 * | 6/2012 | Ueda et al. | 271/12 |
| 2012/0313315 | A1 | 12/2012 | Fukumoto et al. | |
| 2013/0062827 | A1 | 3/2013 | Fuda | |
| 2013/0087967 | A1 | 4/2013 | Fuda et al. | |
| 2013/0106045 | A1 | 5/2013 | Okutsu et al. | |
| 2013/0334764 | A1 | 12/2013 | Fuda | |
| 2014/0084531 | A1 | 3/2014 | Fukumoto at al. | |
| 2014/0131938 | A1 | 5/2014 | Satoh et al. | |
| 2014/0339759 | A1 | 11/2014 | Takahashi at al. | |
| 2014/0339761 | A1 | 11/2014 | Oikawa et al. | |
| 2014/0346728 | A1 | 11/2014 | Fuda et al. | |

FOREIGN PATENT DOCUMENTS

| | | | |
|---|---|---|---|
| JP | S62-121234 | A | 6/1987 |
| JP | H03-23121 | A | 1/1991 |
| JP | H05-186063 | A | 7/1993 |
| JP | 07-196187 | | 8/1995 |
| JP | H08-169568 | A | 7/1996 |
| JP | 2000-327176 | A | 11/2000 |
| JP | 2002-167058 | A | 6/2002 |
| JP | 2004-307106 | A | 11/2004 |
| JP | 3744712 | | 12/2005 |
| JP | 2007-031069 | A | 2/2007 |
| JP | 2010-120721 | | 6/2010 |

* cited by examiner

SHEET FEEDING DEVICE, IMAGE FORMING APPARATUS, AND IMAGE FORMING SYSTEM

CROSS-REFERENCE TO RELATED APPLICATIONS

The present application claims priority to and incorporates by reference the entire contents of Japanese Patent Application No. 2013-259325 filed in Japan on Dec. 16, 2013 and Japanese Patent Application No. 2014-187318 filed in Japan on Sep. 16, 2014.

BACKGROUND OF THE INVENTION

1. Field of the Invention

The present invention relate to a sheet feeding device, an image forming apparatus, and an image forming system.

2. Description of the Related Art

As a method which allows a sheet feeding device used in an image forming apparatus to separate a sheet from piled sheets and convey the sheet, an air separation method which sucks air to draw an uppermost sheet of a piled sheet bundle onto a suction belt is proposed.

Japanese Laid-open Patent Application No. 2010-120721 discloses a sheet feeding device including an air blowing unit configured to suspend multiple sheets of a sheet bundle placed on a sheet stacking member above by directing air toward side faces of a top portion of the sheet bundle in three directions (a front face and both side faces in a width direction of the sheet bundle). The sheet feeding device sucks air to draw an uppermost sheet of the multiple sheets suspended by the air blowing unit onto a suction belt, thereby separating and conveying the uppermost sheet. In Japanese Laid-open Patent Publication No. 2010-120721, an optical reflection sensor which, when the air blowing unit starts blowing air, detects presence or absence of a sheet at a sheet feeding position where the uppermost sheet of the sheet bundle is to be positioned is provided. When a ratio of a period, during which the optical reflection sensor detects presence of a sheet, in a predetermined period after the multiple top sheets of the sheet bundle are suspended by the air blowing unit is equal to or smaller than a preset value, the sheet stacking member is lifted a predetermined amount.

Japanese Laid-open Patent Publication No. 2010-120721 describes the reason why the control operation which lifts the sheet stacking member based on the ratio of the period, during which the optical reflection sensor detects presence of a sheet, in the predetermined period is performed is as follows. The multiple sheets suspended by the air blowing unit behave unstably in such a manner that they occupy various transient positions between the sheet bundle and the suction belt. Therefore, performing a control operation of lifting the sheet stacking member when the optical reflection sensor detects absence of a sheet and stopping lifting the sheet stacking member when the optical reflection sensor detects presence of a sheet causes disadvantages. The disadvantages are, more specifically, that the sheet bundle excessively approaches the suction belt and frequency of multifeeds is increased and that the sheet bundle is excessively separated from the suction belt and sheet feeding capability is decreased.

Japanese Laid-open Patent Publication No. 2010-120721 puts a focus on the following correlation that the closer an uppermost sheet of a sheet bundle which is not suspended (hereinafter, "non-suspended sheet bundle") to the suction belt, the larger the ratio of the period, during which the optical reflection sensor detects presence of a sheet, in the predetermined period when the air blowing unit is blowing air, and employs the control operation which lifts the sheet stacking member based on the ratio of the period, during which the optical reflection sensor detects presence of a sheet, in the predetermined period. This control operation makes it possible to position the non-suspended sheet bundle in a predetermined area, thereby reducing sheet feeding failure.

However, relation between position of the uppermost sheet of the non-suspended sheet bundle and the ratio of the period, during which the optical reflection sensor detects presence of a sheet, varies depending on sheet conditions including an environment where the device is used (hereinafter, "usage environment") and a sheet type. For this reason, there is disadvantageous in that, because it is necessary to make an assessment of relation between position of the uppermost sheet of the non-suspended sheet bundle and ratio of the period, during which the optical reflection sensor detects presence of a sheet, in various sheet conditions including usage environments and sheet types in advance, manufacturing cost will increase. Furthermore, because it is necessary to set the preset value for use in determining whether or not to lift the sheet stacking member the predetermined amount for each of the sheet conditions including the usage environments and the sheet types, a necessary capacity of memory where the preset values are to be stored disadvantageously increases. Furthermore, a detecting unit(s) for detecting a usage environment, a sheet type, and the like are required, the number of parts will disadvantageously be increased, which leads to an increase in cost of the device.

Under the circumstances, there is a need for a sheet feeding device and an image forming apparatus capable of reducing sheet feeding failure while reducing an increase in manufacturing cost and cost of the device.

SUMMARY OF THE INVENTION

It is an object of the present invention to at least partially solve the problems in the conventional technology.

A sheet feeding device includes: a sheet stacking member on which a sheet bundle is to be placed; an air blowing unit configured to blow air onto the sheet bundle placed on the sheet stacking member to suspend multiple sheets of a top portion of the sheet bundle; a lifting/lowering unit configured to lift/lower the sheet stacking member; an optical reflection sensor configured to detect a suspended sheet suspended by the air blowing unit; and a control unit configured to control the lifting/lowering unit based on an output value of the optical reflection sensor. The optical reflection sensor is configured to be capable of detecting an area corresponding to multiple sheets in a sheet suspension zone extending between a non-suspended sheet bundle and a conveying member. The non-suspended sheet bundle is made up of sheets not suspended during a period when air is blown by the air blowing unit. The conveying member is configured to convey an uppermost sheet of the multiple suspended sheets.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments according to the present invention are described below with reference to the accompanying drawings.

Figure 10:
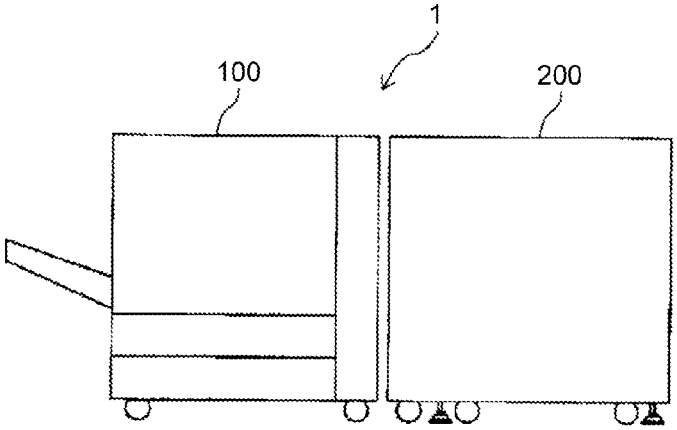
FIG. 10 is a schematic configuration diagram of an image forming system according to the embodiment.

FIG. 10 is a schematic configuration diagram of an image forming system 1 according to an embodiment.

As illustrated in FIG. 10, the image forming system 1 includes an image forming apparatus 100 and a sheet feeding device 200 configured to feed a sheet to the image forming apparatus 100. The sheet feeding device 200 is arranged on a side surface of a body of the image forming apparatus 100.

An overall configuration and operations of an image forming apparatus, such as a printer or a copier having an image formation function similar to that of the printer, to which a sheet feeding device of the embodiment is applicable are described below.

Figure 1:
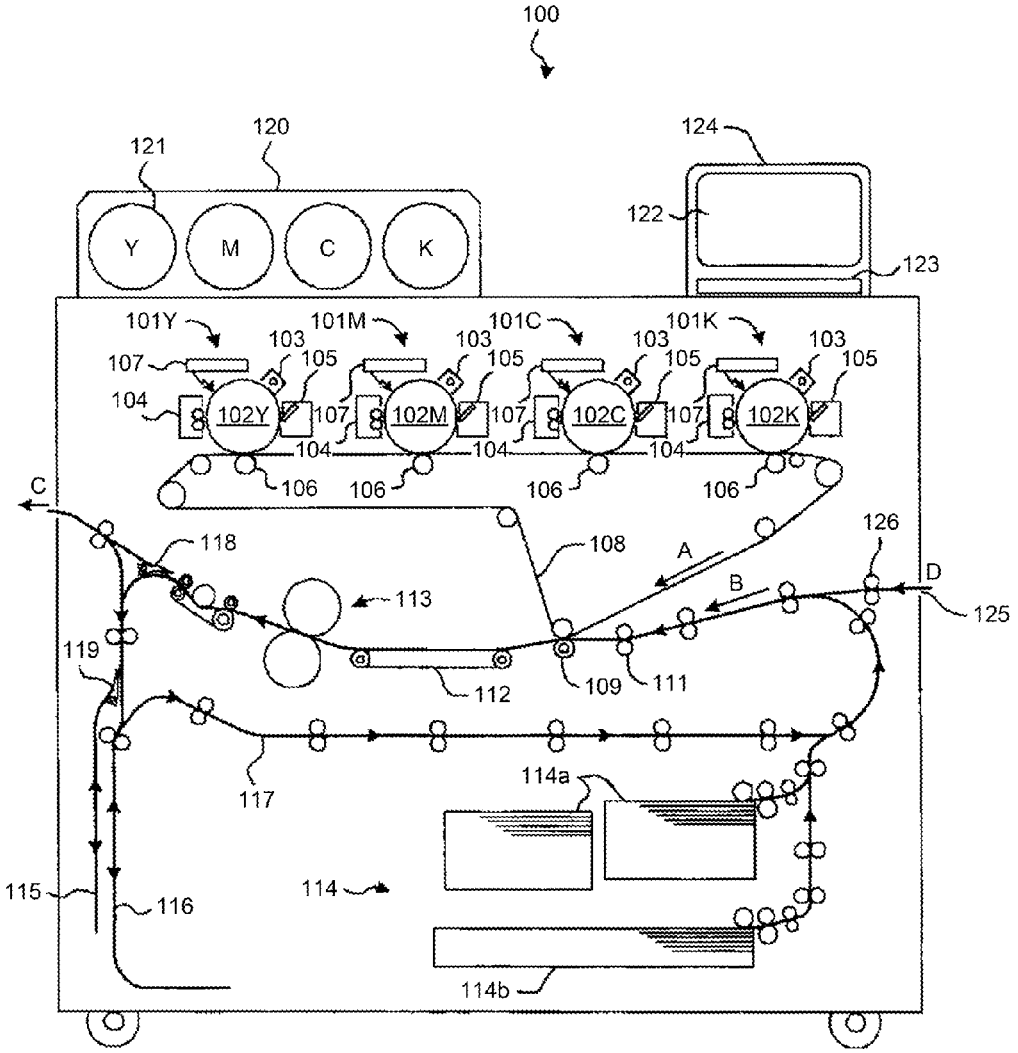
FIG. 1 is a schematic configuration diagram of an image forming apparatus according to an embodiment.

FIG. 1 is a schematic configuration diagram of the image forming apparatus 100 serving as an image forming unit according to the embodiment.

The image forming apparatus 100 is a full-color printer which uses four color toners of yellow (Y), cyan (C), magenta (M), and black (K) or a full-color copier having an image formation function similar to that of the full-color printer. As illustrated in FIG. 1, four image formation units denoted by 101Y, 101M, 101C, and 101K, each of which performs image formation using toner of the corresponding color, are aligned in an upper portion of the apparatus body. The image formation units 101Y, 101M, 101C, and 101K are substantially identical in configuration and operations. Accordingly, the image formation unit is described below with the symbol (Y, M, C, or K) representing the color omitted. The image formation unit 101 includes a photoconductor drum 102 serving as an image bearer. The image formation unit 101 further includes a charger 103, a developing device 104, a cleaning device 105 arranged around the photoconductor drum 102. An exposure unit 107 is arranged above the photoconductor drum 102.

An intermediate transfer belt 108 supported on and around multiple support rollers is arranged below the four image formation units denoted by 101Y, 101M, 101C, and 101K. The intermediate transfer belt 108 is driven to circulate in a direction indicated by an arrow A when one of the support rollers is driven to rotate by a drive unit (not shown). Transfer rollers 106 each serving as a primary transfer unit are arranged to face the respective photoconductor drums 102 of the image formation units across the intermediate transfer belt 108.

In each of the image formation units 101, the charger 103 uniformly deposits charge of a predetermined polarity on the surface of the photoconductor drum 102 that is driven to rotate counterclockwise in FIG. 1. The charged surface is irradiated with an optically-modulated laser beam emitted from the exposure unit 107. An electrostatic latent image is thus formed on the photoconductor drum 102. The electrostatic latent image is developed into a toner image with toner supplied from the developing device 104. Color toner images of yellow, cyan, magenta, and black formed by the image formation units are transferred onto the intermediate transfer belt 108 to be overlaid on one another.

Meanwhile, a sheet feeding unit 114 including sheet feeding trays 114*a* and 114*b* is arranged in a lower portion of the apparatus body. A recording medium, e.g., transfer paper, is fed from either the sheet feeding unit 114 or the sheet feeding device 200, which will be described later, attached to the image forming apparatus 100. The fed transfer sheet is conveyed toward registration rollers 111 as indicated by an arrow B.

The transfer paper is temporarily stopped by being bumped against the registration rollers 111. Thereafter, the transfer paper is delivered, timed to coincide with the toner images on the intermediate transfer belt 108, out from the registration rollers 111 to a secondary transfer portion where a secondary transfer roller 109 contacts the intermediate transfer belt 108. A voltage that is opposite in polarity to the toner is applied to the secondary transfer roller 109, thereby transferring the overlaid toner images (full-color image) on the intermediate transfer belt 108 onto the transfer paper. The transfer paper to which the toner images are transferred is conveyed by a conveying belt 112 to the fixing device 113 where heat and pressure are applied to the transfer paper to fix the toner thereto. The transfer paper where the toner images are fixed is discharged to the outside of the apparatus as indicated by an arrow C and ejected onto a sheet ejection tray (not shown).

When a sheet is to be ejected with the reverse side up (face-down sheet ejection) in a one-sided printing mode, the sheet is turned over by discharging the sheet to the outside of the apparatus as indicated by the arrow C via a sheet turnover unit 115. In a duplex printing mode, after a toner image is fixed on one side of a sheet, the sheet is fed back to the registration rollers 111 via a duplex-printing turnover unit 116 and a sheet re-feed path 117. Another toner image is transferred from the intermediate transfer belt 108 onto the other side of the sheet. The sheet to which the toner image is transferred undergoes fixing in the fixing device 113. As in one-sided printing, the sheet is discharged to the outside of the apparatus as indicated by the arrow C or discharged to the outside of the apparatus as indicated by the arrow C via the sheet turnover unit 115, and ejected onto the sheet ejection tray (not shown). Switching claws 118 and 119 for switching a sheet conveying direction are arranged as appropriate.

In a monochrome printing mode, the image forming apparatus 100 of the embodiment forms a toner image using only the image formation unit 101K for black (K), and transfers the toner image via the intermediate transfer belt 108 onto transfer paper. The sheet where the toner image is fixed is handled as in full-color printing.

A toner-bottle housing 120, in which toner bottles 121 for the respective colors are housed, is arranged on a top surface of the apparatus body. Each of the toner bottles 121 contains toner to be supplied to the developing device 104 of a corresponding one of the image formation units. An operating unit 124 including a display unit 122 and a control panel 123 is also arranged on the top surface of the apparatus body. Furthermore, a conveyed-sheet entrance unit D for receiving sheets conveyed from the sheet feeding device (see FIG. 2), which will be described later, is arranged in a side surface of the apparatus body on the right side in FIG. 1. The conveyed-sheet entrance unit D has an opening 125 via which a sheet is to be received and includes a conveying unit 126 which conveys the sheet.

Figure 2:
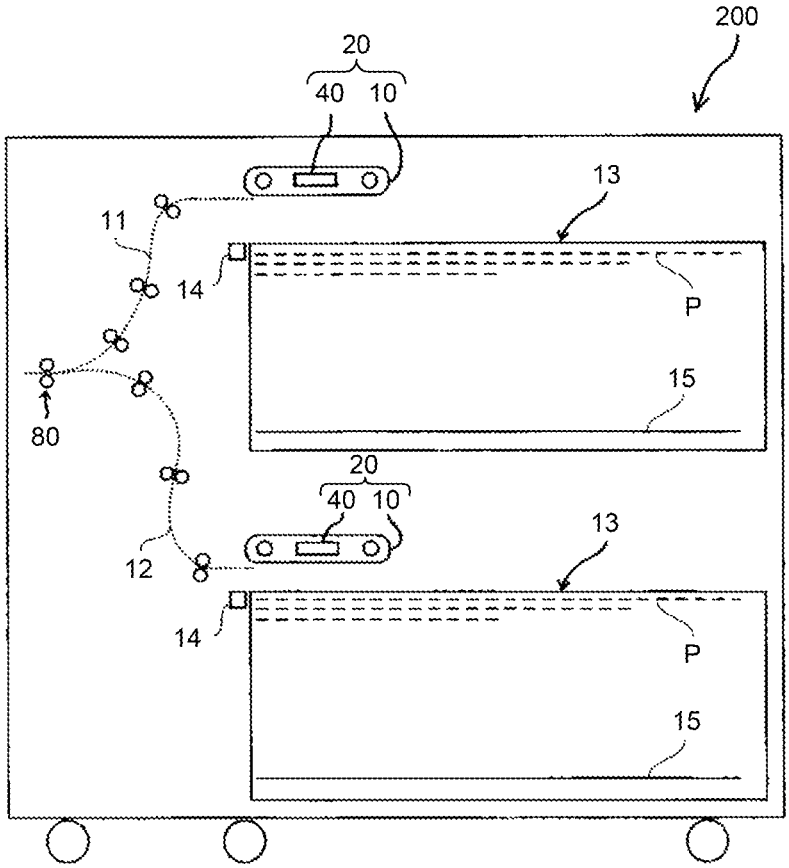
FIG. 2 is a schematic configuration diagram of a sheet feeding device according to the embodiment.

FIG. 2 is a schematic explanatory diagram of the sheet feeding device 200 of the embodiment arranged on the side surface of the apparatus body.

The sheet feeding device 200 includes sheet feeding trays 13 which are vertically arranged in two layers. Sheet feeding units 20 are arranged above the respective sheet feeding trays 13. Each of the sheet feeding units 20 separates a sheet from sheets P placed in the sheet feeding tray 13 and feeds the sheet. The sheet feeding unit 20 includes a suction belt 10, which serves as a conveying member, and a suction device 40. Each of the sheet feeding trays 13 includes a bottom plate 15 where a bundle of the sheets P is to be placed. In the embodiment, each of the sheet feeding trays is capable of containing up to approximately 2,500 sheets. Each of the sheet feeding trays 13 includes a sheet detection sensor 14 for use in controlling lifting/lowering of the bottom plate 15.

Sheets placed in the lower sheet feeding tray 13 are conveyed via a lower conveying path 12 and conveyed by a pair of exit rollers 80 to the body of the copier 100. Sheets placed in the upper sheet feeding tray 13 are conveyed via an upper conveying path 11 and conveyed by the pair of exit rollers 80 to the body of the copier 100.

Figure 3:
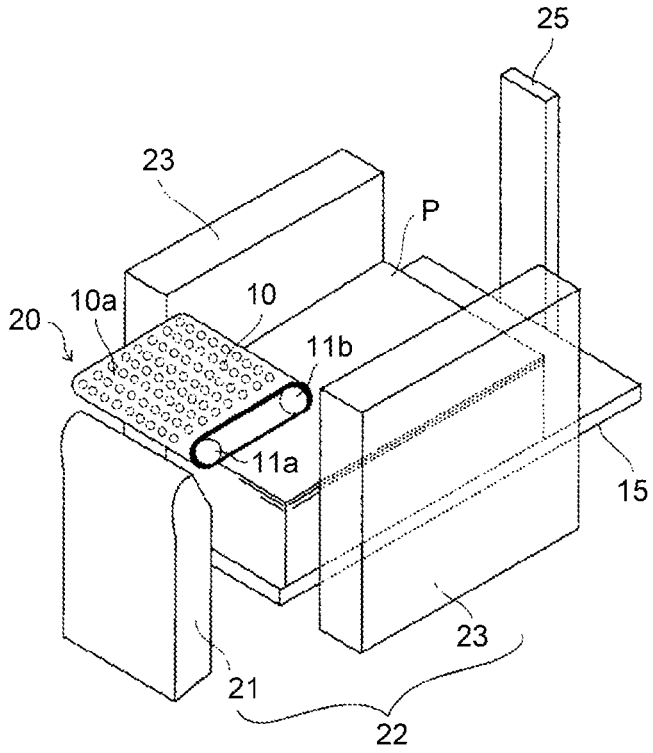
FIG. 3 is a schematic perspective view of a sheet feeding tray of the sheet feeding device and its surrounding components.
Figure 11:
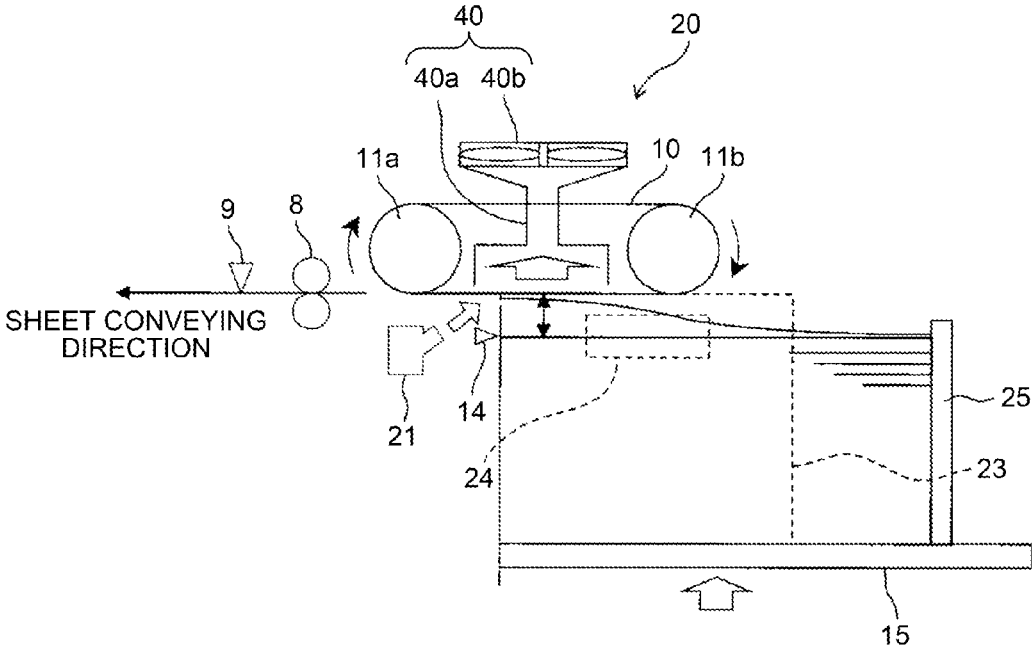
FIG. 11 is a schematic cross-sectional view of the sheet feeding tray and its surrounding components.

FIG. 3 is a schematic perspective view of the sheet feeding tray 13 and its surrounding components. FIG. 11 is a schematic cross-sectional view of the sheet feeding tray 13 and its surrounding components.

The suction belt 10 of the sheet feeding unit 20 is supported by and stretched between two stretching rollers denoted by 11*a* and 11*b*. Suction holes 10*a* extending from a front side to a back side of the belt are defined over the entire peripheral area of the suction belt 10. The suction device 40 illustrated in FIG. 2 is arranged inside a loop of the suction belt 10. As illustrated in FIG. 11, the suction device 40 includes a duct 40*a* which is an air passage, and a suction fan 40*b* which sucks air via the duct 40*a*. The suction device 40 acts to draw the sheet P onto a lower surface of the suction belt 10 by creating a negative pressure beneath the suction device 40.

The sheet feeding tray 13 further includes an air blowing device 22 serving as an air blowing unit which blows air onto sheets of a top portion of the sheet bundle P. The air blowing device 22 includes a front duct 21 via which air is blown against a leading end (i.e., downstream end in the sheet feeding direction) of the top portion of the sheet bundle P. The air blowing device 22 further includes side ducts 24 (see FIG. 11) arranged in a pair of side fences 23. The air blowing device 22 includes a blower fan 22*a* (see FIG. 5). The air blowing device 22 supplies air into the front duct 21 and the pair of side ducts 24 using the blower fan 22*a*. The air supplied into the front duct 21 is discharged from a portion facing the leading end (the downstream end in the sheet feeding direction) of the top portion of the sheet bundle P and blown against the leading end (the downstream end in the sheet feeding direction) of the top portion of the sheet bundle P. The air delivered into the side ducts 24 is discharged from discharge ports (not shown) which are provided in the respective side fences 23 at portions facing the top portion of the sheet bundle P and blown against side surfaces of the top portion of the sheet bundle P. The air blown through the front duct 21 and the discharge ports (not shown) in the pair of side fences suspends sheets of the top portion of the sheet bundle.

As illustrated in FIG. 11, a pair of conveying rollers 8 serving as a downstream conveying member is arranged downstream in the conveying direction of the suction belt 10. The pair of conveying rollers 8 conveys the sheet conveyed to a nip between the pair of conveying rollers 8 by the suction belt 10 further downstream. The pair of conveying rollers 8 is configured to exert a conveying force larger than a conveying force exerted by the suction belt 10. A sheet feed sensor 9 which detects passage of a sheet is arranged downstream, in the conveying direction, of the pair of conveying rollers 8.

The sheet feeding tray 13 includes an end fence 25 which aligns a trailing end of the sheet bundle P placed on the bottom plate 15.

Figure 4:
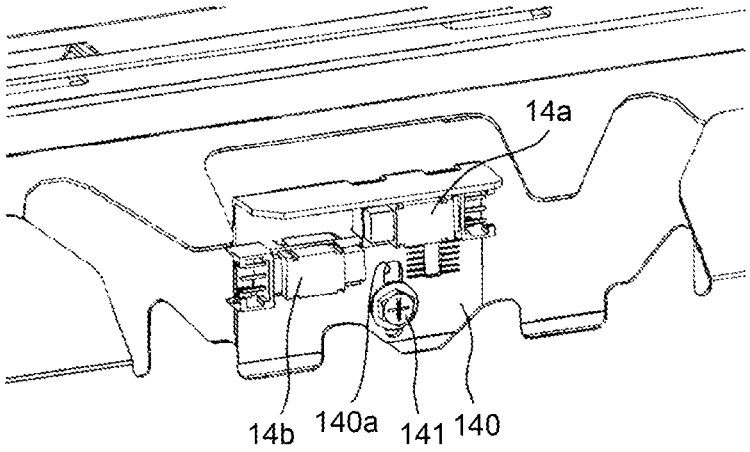
FIG. 4 is a perspective view illustrating a sheet detection sensor.

FIG. 4 is a perspective view illustrating the sheet detection sensor 14.

As illustrated in FIG. 4, two sheet detection sensors denoted by 14*a* and 14*b* are arranged in a direction in which the sheets are piled (hereinafter, "the sheet piling direction"). Each of the sheet detection sensors 14*a* and 14*b* is an optical reflection sensor which includes a light-emitting element and a light-receiving element. In the embodiment, as will be described later, sheet detection is performed using one of the two sheet detection sensors denoted by 14*a* and 14*b* depending on a sheet type.

The two sheet detection sensors denoted by 14*a* and 14*b* are attached to the same fixing member 140. The fixing member 140 is fixed to a side plate (not shown) of the sheet feeding device 200 with a screw 141. The screw 141 passes through the fixing member 140 via an elongated hole 140*a* elongated in the sheet piling direction. This structure allows fine adjustment of a detection position of the sheet detection sensors 14*a* and 14*b* attached to the fixing member 140 in a lifting/lowering direction of the sheet bundle P by loosening the screw 141 and thereafter moving the fixing member 140 in the sheet piling direction. Thus, sheet feeding of various types of sheets can be supported.

Figure 5:
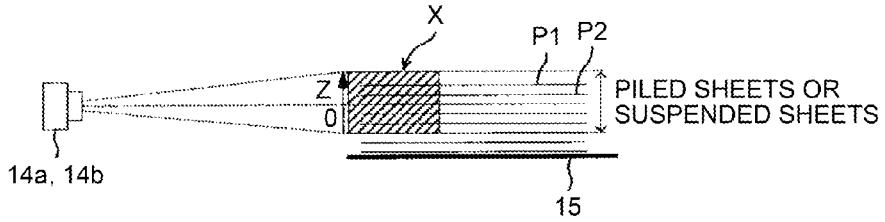
FIG. 5 is an explanatory diagram of the sheet detection sensor of the embodiment.

FIG. 5 is an explanatory diagram of the sheet detection sensor 14*a*, 14*b* of the embodiment.

As illustrated in FIG. 5, a detection area X of the sheet detection sensor 14*a*, 14*b* of the embodiment has a certain length in the Z direction (vertical direction) in FIG. 5. The sheet detection sensor 14*a*, 14*b* is therefore capable of detecting multiple sheets. More specifically, an area to be irradiated with light from the light-emitting element of the sheet detection sensor 14*a*, 14*b* is defined as the detection area X. The sheet detection sensor 14*a*, 14*b* is configured to converge light that is emitted from the light-emitting element and thereafter reflected from the detection area X through a lens, and receive the reflected light with the light-receiving element. The sheet detection sensor 14*a*, 14*b* configured in this manner is capable of detecting intensity of the light reflected from the detection area X. In the embodiment, the length of the detection area X in the lifting/lowering direction of the sheet bundle P is set to 3 mm.

Figure 6:
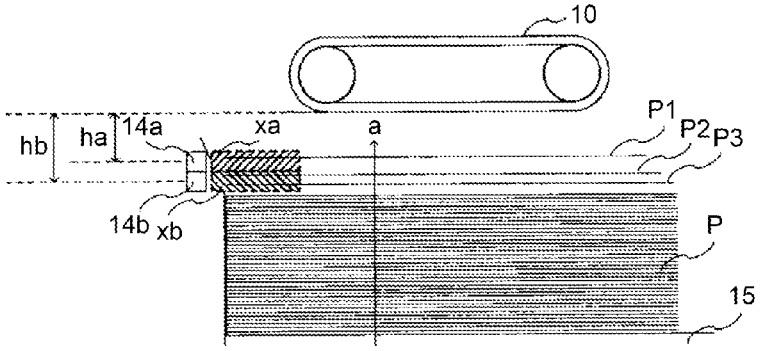
FIG. 6 is a diagram illustrating relative positions of a suction belt and sheet detection sensors.

FIG. 6 is a diagram illustrating relative positions of the suction belt 10 and the sheet detection sensors 14*a* and 14*b*.

As illustrated in FIG. 6, hb, which is the distance from a vertical center position of the lower sheet detection sensor 14*b* to the suction belt 10, is larger than ha, which is the distance from a vertical center position of the upper sheet detection sensor 14*a* to the suction belt 10.

When, for example, sheets of heavy paper such as thick paper are placed on the bottom plate 15, a suction force of the air blowing device 22 and the suction device 40 may be insufficient to lift one of the sheets and, as a result, a failure in drawing the sheet onto the suction belt 10 can occur. When sheets of paper, such as thick paper, heavier than ordinary paper are placed on the bottom plate 15 as in this case, lifting of the sheet bundle is preferably controlled using the upper sheet detection sensor 14*a*. On the other hand, when sheets of ordinary or lighter paper are used, lifting of the sheet bundle P is preferably controlled using the lower sheet detection sensor 14*b*.

Figure 7:
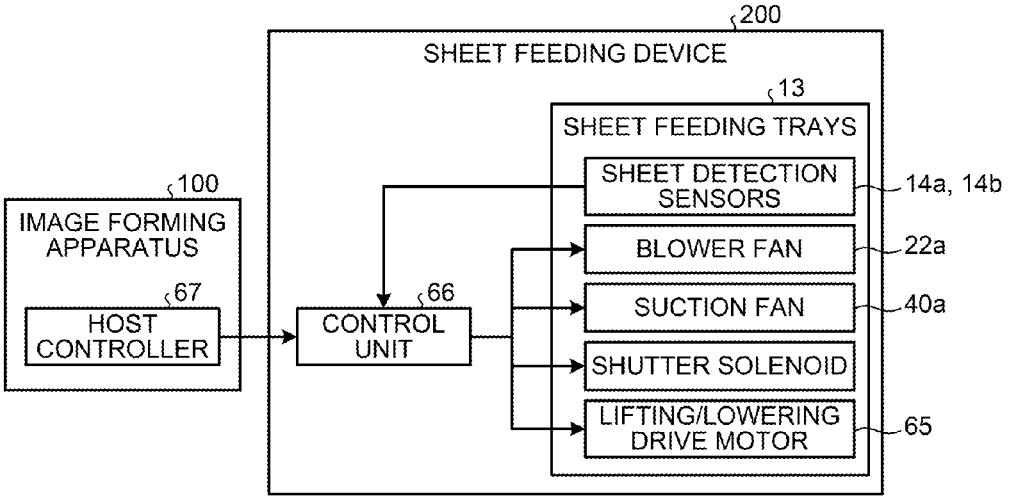
FIG. 7 is a block diagram illustrating an example configuration of a relevant portion of a control system of the copier.

FIG. 7 is a block diagram illustrating an example configuration of a relevant portion of a control system of the image forming apparatus 100. Referring to FIG. 7, the sheet detection sensors 14*a* and 14*b* of the sheet feeding trays 13 are connected to a control unit 66 which serves as a control unit of the sheet feeding device 200. The blower fan 22*a*, which delivers air to the front duct 21 and to the side ducts (not shown), and the suction fan 40*a* included in the suction device 40 are also connected to the control unit 66. A lifting/lowering drive motor 65 which lifts/lowers the bottom plate 15 is also connected to the control unit 66. The control unit 66 of the sheet feeding device 200 is connected to a host controller 67 of the image forming apparatus 100. Various devices, including the operating unit 124, of the image forming apparatus 100 are connected to the host controller 67.

Figure 8:
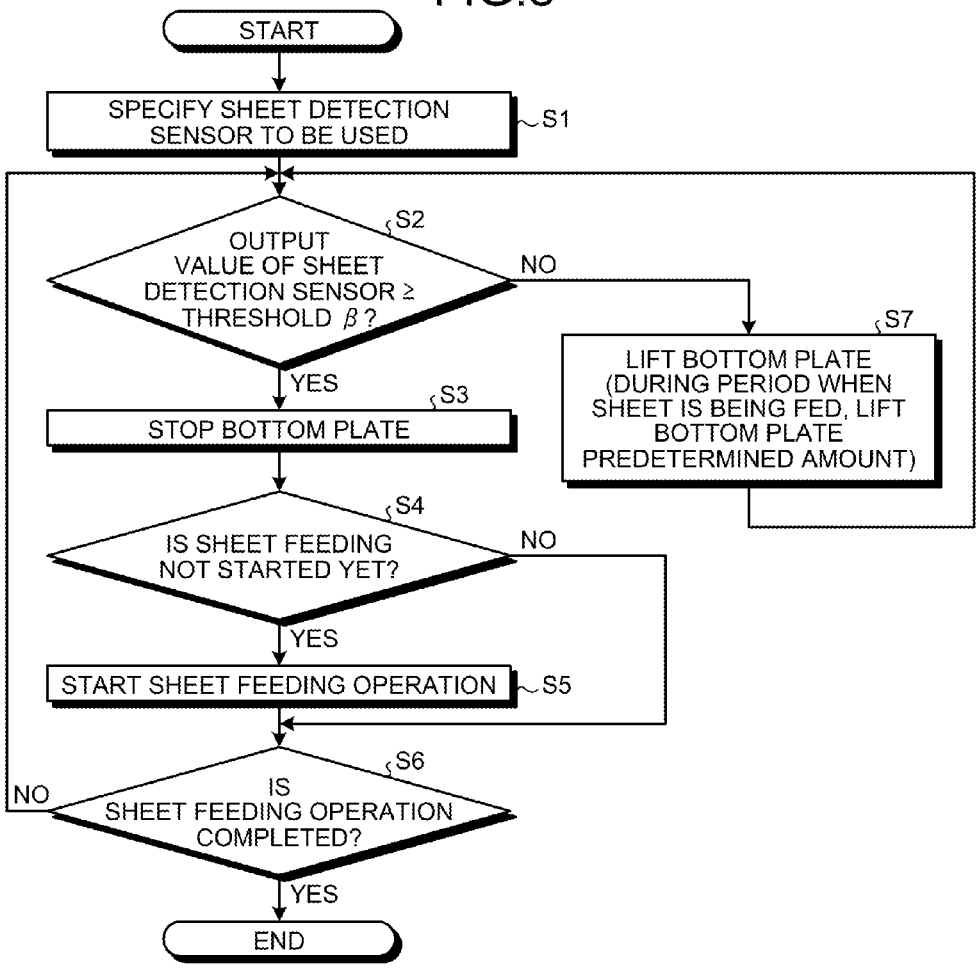
FIG. 8 is a flowchart for sheet feeding control.

FIG. 8 is a flowchart for sheet feeding control of the embodiment.

FIGS. 12 to 15 are explanatory diagrams for describing the sheet feeding control of the embodiment.

The host controller 67 of the image forming apparatus 100 receives a command to form an image using a sheet(s) placed in the sheet feeding trays 13 of the sheet feeding device 200. The command is entered using the operating unit 124 of the image forming apparatus 100 or the like. Upon receiving the command, the host controller 67 transmits a sheet feeding command and information about types of sheets placed in the sheet feeding trays 13 and the like to the control unit 66 of the sheet feeding device 200. Upon receiving the sheet feeding command, the control unit 66 determines which sheet detection sensor is to be used based on the information about the types of the sheets placed in the sheet feeding trays 13 received from the host controller 67 (S1). In the embodiment, the host controller 67 determines (selects) which one of the upper sheet detection sensor 14*a* and the lower sheet detection sensor 14*b* is to be used. The information about the types of the sheets placed in the sheet feeding trays 13 and the like is configured to be entered by a user using the operating unit 124 arranged on the image forming apparatus 100 or the like.

The control unit 66 determines whether or not an output value of the selected sheet detection sensor is equal to or larger than a threshold β (S2). If the output value is not equal to or larger than threshold β (No at S2), the control unit 66 drives the lifting/lowering drive motor 65 to lift the bottom plate 15 (S7). As a result, a top portion of a sheet bundle enters the detection area X of the sheet detection sensor. Light emitted from the light-emitting element of the sheet detection sensor is reflected from the top portion of the sheet bundle and received by the light-receiving element. As a result, the output value of the sheet detection sensor increases. If the output value becomes equal to or larger than the threshold β (Yes at S2), the control unit 66 stops driving the lifting/lowering drive motor 65, thereby stopping lifting the bottom plate 15 (S3). The top surface of the sheet bundle can be positioned at a sheet feeding position in this manner.

The threshold β is described below. In the embodiment, the threshold β is set to an output value of the sheet detection sensor in a state where a specified number A (A>1) of suspended sheets are present in the detection area X.

Figure 9:
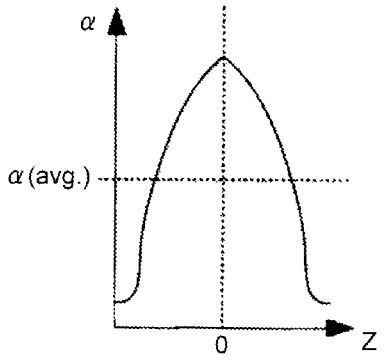
FIG. 9 is a graph of sheet reflectivity a at various positions with reference to a vertical center (in the Z direction) of the detection area X illustrated in FIG. 5.

FIG. 9 is a graph of sheet reflectivity a at various positions with reference to a center of the detection area X of FIG. 5 in the vertical direction (in the Z direction).

As illustrated in FIG. 9, the reflectivity of the sheet varies depending on the position in the Z direction. In the embodiment, α(avg.), which is an average of reflectivities of a single sheet in the detection area X, is used as the reflectivity (output value of the sheet detection sensor) of the single sheet. Therefore, the threshold β can be expressed as: $\beta=\alpha(\text{avg.})\times A$, where A is the specified number of sheets (A>1). FIG. 9 is a graph of the sheet reflectivity a of ordinary paper. The threshold β is an output value of the sheet detection sensor in a state where the specified number A of sheets of ordinary paper are present in the detection area X.

In the embodiment, an output value of the sheet detection sensor in a state where the specified number A (A>1) of suspended sheets are present in the detection area X is used as the threshold β. Accordingly, when the bottom plate is gradually lifted before a sheet feeding operation is started, the output value of the sheet detection sensor reaches the threshold β when the top surface of the sheet bundle is located at a position, which is below the reference 0 illustrated in FIG. 5.

Figure 12:
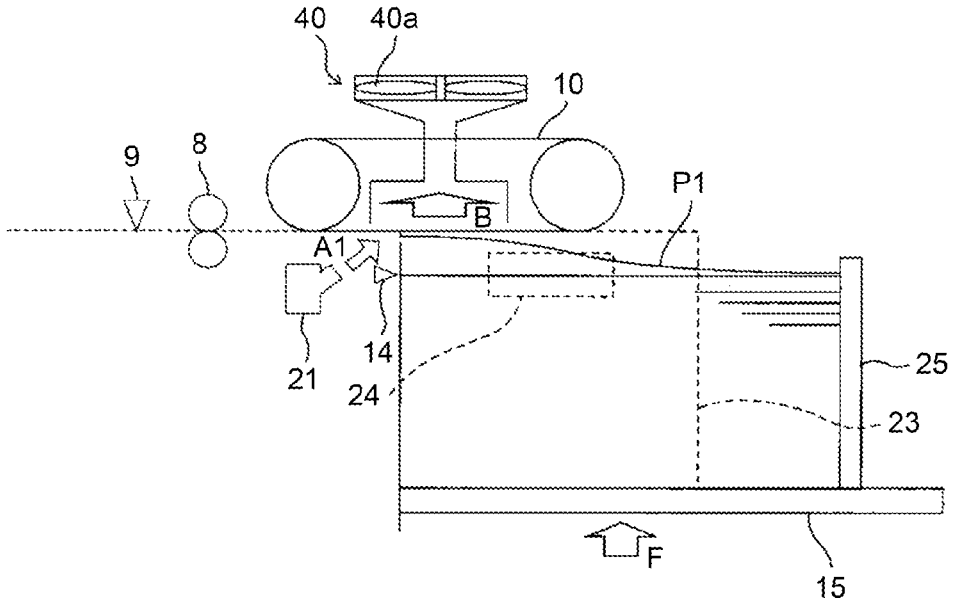
FIG. 12 is an explanatory diagram illustrating a state where the sheet feeding device of the embodiment has started blowing and suctioning air.

Thereafter, if the sheet feeding operation is not started yet (Yes at S4), the control unit 66 starts the sheet feeding operation (S5). More specifically, the control unit 66 starts driving the air blowing device 22 (the blower fan 22*a*) with the suction belt 10 stopped. As a result, air is ejected through a discharge port of the front duct 21 in a direction indicated by an arrow A1 and blown against a front end of the top portion of the sheet bundle as illustrated in FIG. 12. Air is also ejected through the discharge ports of the side ducts 24 of the pair of side fences 23 and blown against side ends of the top portion of the sheet bundle. Simultaneously, the control unit 66 starts driving the suction fan 40*a* to start suction by the suction device 40. Starting, by the air blowing device 22, blowing air to the top portion of the sheet bundle causes sheets of the top portion of the sheet bundle to be suspended. Starting, by the suction device 40, suction creates such a negative pressure as that indicated by an arrow B in FIG. 12 below the suction device 40, and draws an uppermost sheet P1 of the suspended sheets onto the suction belt 10.

During a period when the uppermost sheet P1 is drawn onto the suction belt 10, a next sheet P2 flaps below the uppermost sheet P1 by air blown from the air blowing device 22. This causes a leading end of the next sheet to be separated from the remainder sheets below the next sheet.

The control unit 66 controls an amount of air to be blown from the air blowing device 22 against a top surface portion of the sheet bundle based on the information about the type of the sheets placed in the sheet feeding tray 13 received from the host controller 67. Ease of separating individual sheets varies depending on the sheet type, which can be transparency, tracing paper, coated paper with smooth surface, perforated or streaked sheet, and offset-printed sheet coated with powder. For example, when a large amount of air is blown against sheets of thin paper such as tracing paper, suspended sheets can flap violently and a multifeed or a wrinkle in the sheets can be caused. When a small amount of air is blown against sheets of transparency film, or perforated or streaked sheets, air can fail to enter between the sheets, and a failure in separating and suspending the sheets can occur. However, by adjusting the amount of air to be blown against a bundle of sheets depending on a sheet type of the sheets, separating the sheets and suspending sheets of a top portion of the sheet bundle can be reliably achieved while preventing, or at least reducing, violent flapping of suspended sheets.

Figure 13:
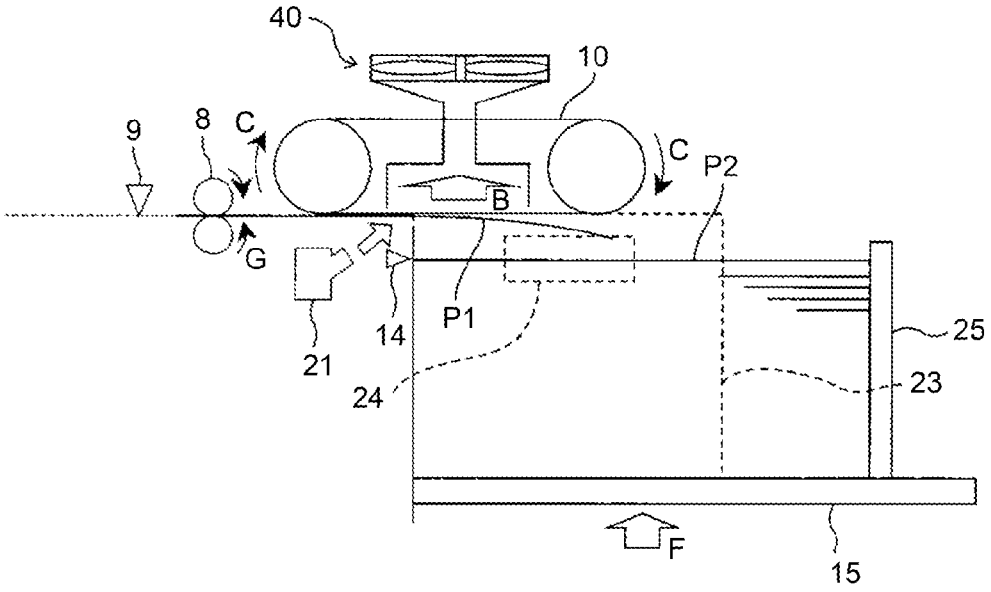
FIG. 13 is an explanatory diagram of a state, which follows the state illustrated in FIG. 12, where the sheet feeding device has started driving a suction belt and a pair of conveying rollers.

After a lapse of a predetermined period of time (e.g., 3 seconds) since suction by the suction device 40 is started, the control unit 66 starts driving the suction belt 10 with the blower fan 22*a* and the suction fan 40*a* operating as illustrated in FIG. 13. As a result, the suction belt 10 circulates in a direction indicated by arrows C in FIG. 13 to convey the uppermost sheet P1 drawn onto the lower surface of the suction belt 10 to the pair of conveying rollers 8. Thereafter, rotations of the pair of conveying rollers 8 in directions indicated by arrows G in FIG. 13 convey the uppermost sheet P1 to the image forming apparatus 100.

Figure 14:
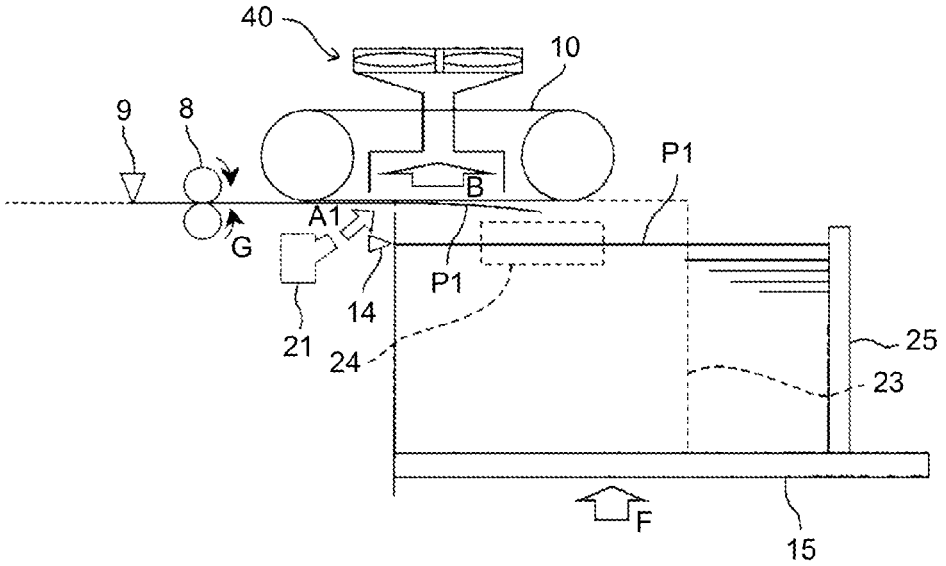
FIG. 14 is an explanatory diagram of a state, which follows the state illustrated in FIG. 13, where the sheet feeding device has stopped driving the suction belt.

As illustrated in FIG. 14, when a leading end of the uppermost sheet P1 conveyed by the suction belt 10 and the pair of conveying rollers 8 is detected by the sheet feed sensor 9, the control unit 66 stops driving the suction belt 10. When driving of the suction belt 10 is stopped with the suction device 40 operating, a stopping force which acts to stop the conveyance of the uppermost sheet P1 is applied to the uppermost sheet P1 at a portion where the uppermost sheet P1 is drawn onto the suction belt 10. However, a material of which the pair of conveying rollers 8 is made and a nip pressure are employed so that the conveying force exerted by the pair of conveying rollers 8 to the sheet P is sufficiently larger than the stopping force. Accordingly, even after the suction belt 10 is stopped, the uppermost sheet P1 continues to be conveyed by the conveying force exerted by the pair of conveying rollers 8.

Figure 15:
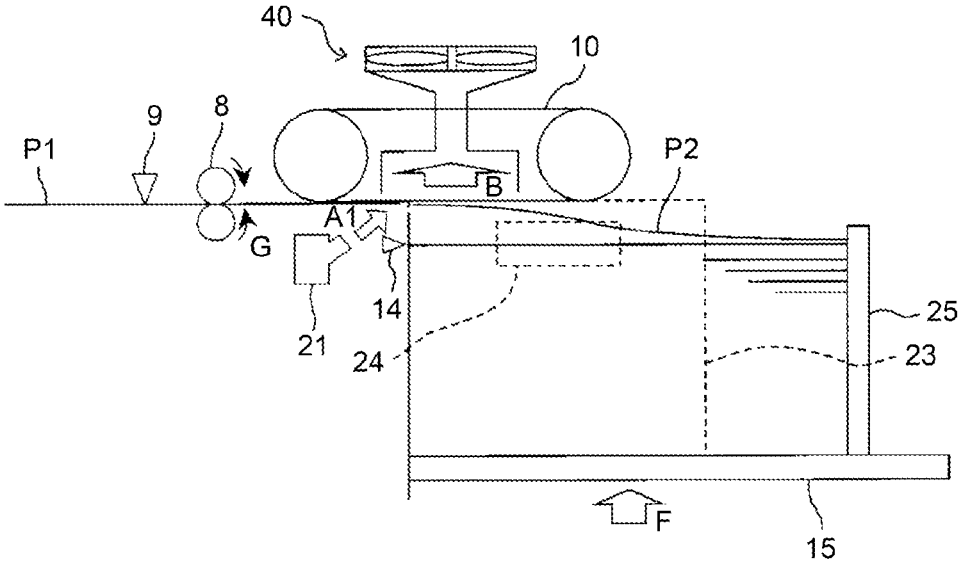
FIG. 15 is an explanatory diagram of a state, which follows the state illustrated in FIG. 14, where a trailing end of a sheet has passed a suction area.

Immediately after a trailing end of the uppermost sheet P1 has passed a suction area of the suction device 40, flows of air produced between the air blowing device 22 and the suction device 40 suspend the next sheet and draw the next sheet onto the suction belt 10 as illustrated in FIG. 15.

When there is a next sheet, the sheet feeding operation is continued. More specifically, the control unit 66 resumes driving the suction belt 10 after a lapse of a predetermined period of time, which depends on preset sheet feeding intervals, since the leading end of the uppermost sheet P1 illustrated in FIG. 14 is detected by the sheet feed sensor 9. Sheets in the sheet feeding tray 13 are fed one sheet by one sheet to the image forming apparatus 100 at the predetermined sheet feeding intervals in this manner.

When the sheet feeding operation is to be continued (Yes at S6), the control unit 66 continues monitoring whether or not an output value of the sheet detection sensor is the threshold β (S2).

Using a sheet detection sensor which detects "presence" or "absence" of a sheet as the sheet detection sensor can cause the following disadvantage. That is, a sheet detection sensor which detects "presence" or "absence" of a sheet performs detection in a small detection area corresponding to no more than one sheet so that the sheet detection sensor can output one of two values which correspond to "ON" (a sheet is present) and "OFF" (a sheet is absent). In other words, the detection area of the sheet detection sensor in the vertical direction corresponds to no more than one sheet. Using such a small detection area allows detection of "presence" or "absence" of a sheet at the detection position with high accuracy. However, using such a sheet detection sensor which detects "presence" or "absence" of a sheet is disadvantageous as follows. That is, even small flapping of suspended sheets can displace a to-be-detected sheet out of the detection area. Consequently, the sheet detection sensor detects "absence" of a sheet, and the bottom plate 15 is undesirably lifted. This lifting causes a top portion of a non-suspended sheet bundle to enter an area against which air is blown by the air blowing device 22, and an uppermost sheet of the non-suspended sheet bundle to be suspended. As a result, the number of suspended sheets in a zone (sheet suspension zone) between a top surface of the non-suspended sheet bundle and the suction belt increases. As the number of the suspended sheets increases, the density of the suspended sheets in the sheet suspension zone increases. In this state, the suspended sheets cannot move in the vertical direction sufficiently, causing sheets to be separated insufficiently. As a result, multiple suspended sheets can be drawn onto the suction belt 10 and cause a multifeed.

If a suspended sheet remains in the detection area of the sheet detection sensor for a predetermined period of time even after the uppermost sheet of the multiple suspended sheets has been conveyed, the sheet detection sensor detects "presence" of a sheet. In this case, the non-suspended sheet bundle is lifted later than predetermined timing. As a result, because the number of the suspended sheets decreases, the density of the suspended sheets in the sheet suspension zone decreases, and the suspended sheets undesirably move violently in the vertical direction. This can result in an undesirable situation that an uppermost sheet of the multiple suspended sheets does not approach the suction belt 10 and therefore is not drawn onto the suction belt 10 before time to convey a next sheet comes. As a result, sheet feeding failure will occur.

By contrast, in the embodiment, the detection area X of the sheet detection sensor is extended in the vertical direction (the Z direction). As described above, the sheet feeding position where the top surface of the sheet bundle is positioned before start of sheet feeding is below the reference 0 illustrated in FIG. 5. In other words, the detection area X contains a detection area corresponding to multiple sheets above the sheet feeding position. Accordingly, when multiple sheets of the sheet bundle are suspended, the sheet detection sensor 14 can detect a vertically large area of approximately several millimeters in the sheet suspension zone. Hence, the density of suspended sheets (more specifically, whether or not the suspended sheets are dense or sparse) in the sheet suspension zone can be detected from an output value of the sheet detection sensor 14. More specifically, when the suspended sheets are dense in the sheet suspension zone, the number of suspended sheets in the detection area being the predetermined area to be detected in the sheet suspension zone is large, and the output value of the sheet detection sensor 14 is high. By contrast, when the suspended sheets are sparse in the sheet suspension zone, the number of suspended sheets in the detection area being the predetermined area to be detected in the sheet suspension zone is low. In this case, the output value of the sheet detection sensor 14 is small. Because the sheet detection sensor 14 detects a vertically large area of approximately several millimeters in the sheet suspension zone in this manner, the density of suspended sheets (more specifically, whether or not the suspended sheets are dense or sparse) in the sheet suspension zone is detectable from an output value of the sheet detection sensor 14.

Because the sheet detection sensor can detect a vertically large area in the sheet suspension zone in this manner, so long as the number of suspended sheets is the specified number at which individual sheets can be separated favorably, the density of the sheets in the detection area X of the sheet detection sensor 14 is constant even if the suspended sheets behave slightly unstably. Accordingly, the sheet detection sensor 14 outputs a value equal to or larger than the threshold β. When the uppermost sheet of the multiple suspended sheets has been conveyed by the suction belt 10 and the number of the suspended sheets is decreased, the number of sheets in the detection area X of the sheet detection sensor 14 becomes (A−1) that is smaller than the specified number A, and the density decreases. As a result, the sheet detection sensor 14 outputs a value smaller than the threshold β (No at S2). Accordingly, the control unit 66 drives the lifting/lowering drive motor 65 to lift the bottom plate 15 (S7).

Meanwhile, during the sheet feeding operation, a control operation which stops lifting the bottom plate 15 after the bottom plate 15 has been lifted a predetermined amount (e.g., 1 millimeter) rather than when the output value of the sheet sensor reaches the threshold β is performed. The reason why the bottom plate 15 is controlled in this manner is described below. As the bottom plate 15 is gradually lifted, sheets in a top portion of the non-suspended sheet bundle are suspended by the air blowing device 22, and the number of sheets present in the area X reaches the specified number A. However, it takes a certain period of time until the sheets become suspended. Accordingly, if a control operation which stops lifting the bottom plate 15 when the output value becomes greater than or equal to the threshold β is performed, the bottom plate 15 can be lifted excessively. For this reason, the control operation which stops lifting the bottom plate 15 after lifting the bottom plate 15 the predetermined amount (e.g., 1 millimeter) is employed.

Thus, in the embodiment, when the number of suspended sheets decreases, an output value of the sheet detection sensor decreases to a value smaller than the threshold β. Accordingly, the bottom plate 15 can be lifted when the number of suspended sheets has decreased. Because a delay in lifting the bottom plate 15 can thus be prevented, or at least reduced, an undesirable situation that no sheet is drawn onto the suction belt even though time to convey a next sheet comes can be prevented, and therefore sheet feeding failure can be reduced.

As described above, the threshold β is an output value of the sheet detection sensor in a state where the specified number A of sheets of ordinary paper are present in the detection area. For example, when sheets of thick paper are used, the number of suspended sheets is smaller than that of ordinary paper, and therefore the specified number A of sheets is not present in the detection area. However, because thick paper are thicker than ordinary paper, even when the number of sheets in the detection area is smaller than that of ordinary paper, the density of the sheets in the detection area remains substantially the same. Accordingly, even if the control operation of lifting/lowering the bottom plate 15 based on the threshold β is applied to thick paper, the position of the sheet bundle can be controlled highly accurately, and the distance between the suction belt 10 and the top surface of the sheet bundle can be maintained within a predetermined range. Thus, according to the embodiment, even if the threshold β is not determined in advance for each of sheet types, the distance between the suction belt 10 and the top surface of the sheet bundle can be maintained within the predetermined range. Because a necessary capacity of a memory where the threshold β are to be stored can be reduced, a less expensive memory can be satisfactorily used and, accordingly, an increase in cost of the apparatus can be reduced.

Meanwhile, in an environment, which may be, for example, a high-humidity environment or some sheet conditions, where sheets are likely to cling to each other, individual sheets are less easily separated. In such an environment, sheets of a sheet bundle will not be separated even if the sheet bundle is at a position in normal time. If the sheets are not separated, the number of suspended sheets fails to achieve the specified number A, and the sheet detection sensor outputs a value smaller than the threshold β. For this reason, in such an environment, the sheet bundle is desirably lifted to a position above the position in the normal time. When the sheet bundle is lifted higher, an uppermost sheet of the sheet bundle is strongly affected by the flow of air produced between the air blowing device 22 and the suction device 40. As a result, the uppermost sheet can be suspended, the number of suspended sheets reaches the specified number A, and the output value of the sheet detection sensor reaches the threshold β. A favorable sheet feeding capability can be maintained in this manner even in a high-humidity environment or even if a sheet condition or the like varies. Furthermore, the need of determining a threshold for each of environments and for each of sheet conditions in advance is eliminated. Accordingly, because a necessary capacity of the memory where the thresholds are to be stored can be reduced, a less expensive memory can be satisfactorily used, and therefore an increase in cost of the apparatus can be reduced. Furthermore, because the need of a sensor for detecting a sheet condition and a sensor for detecting an environment is eliminated, the number of parts can be reduced, and the apparatus can be made less expensive.

Generally, sheet feeding units adopting roller conveyance system are widely used as sheet feeding units which separate and convey sheets one sheet by one sheet. The roller conveyance system conveys sheets one sheet by one sheet using a roller having a surface made of an elastic body, such as rubber, having a high friction coefficient. The system brings the roller surface into contact with a sheet, thereby separating and conveying the sheet with a frictional force between the sheet and the roller surface.

As for the sheets, sheets of gloss coated paper, high quality paper, pre-printed paper, recycled paper, or the like may be used in some cases. A sheet of gloss coated paper is produced by applying resin or the like onto a surface of the sheet to increase gloss of the surface and accordingly has a high surface smoothness. When sheets of such gloss coated paper are used, the sheet feeding device adopting the roller conveyance system cannot obtain a necessary frictional force between the sheet and the roller surface and therefore cannot provide sufficient sheet feeding capability.

When sheets of pre-printed paper are used, paper releasing agent (powder) applied to the sheet is transferred to the roller surface and adheres thereto. When sheets of recycled paper are used, paper dust is transferred to the roller surface and adheres thereto. In both cases, a disadvantage that because the frictional force between the sheet and the roller surface decreases, sufficient sheet feeding capability cannot be provided stably over a long period arises.

By contrast, in the embodiment, the sheet feeding unit adapting an air conveyance system is used. The air conveyance system separates and conveys sheets as described above. More specifically, air is blown toward a top portion of a sheet bundle from around the sheet bundle to suspend sheets in the top portion. An uppermost sheet of the sheet bundle is drawn onto the suction belt 10 by making use of the pressures difference by the air flow produced by the suction device 40 to convey the sheets one sheet by one sheet. Such an air conveyance system is structurally advantageous in being adoptable to various types of sheets.

Figure 16:
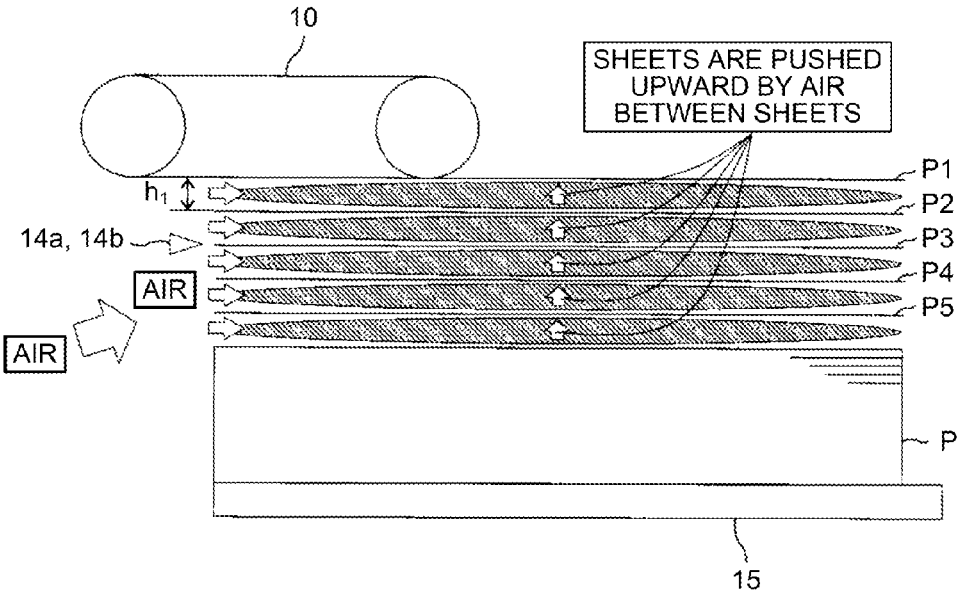
FIG. 16 is a diagram illustrating a state where, in a condition where a large number of sheets are placed on a bottom plate, sheets are pushed up by air blown to between the sheets.

FIG. 16 is a diagram illustrating a state where, in a condition where a large number of sheets are placed on the bottom plate 15, sheets are pushed up by air blown to between the sheets.

In a condition where a large number of sheets are placed on the bottom plate 15 as in FIG. 16, a predetermined number of sheets are suspended by air blown to between the sheets. Accordingly, the density of the suspended sheets in the sheet suspension zone (space between a non-suspended sheet bundle P and the suction belt 10) is maintained constant. In this state, air spaces between the suspended sheets serve as layered air cushions in such a manner that a lower sheet of each pair of adjacent suspended sheets supports an upper sheet. The sheets are suspended above the belt with substantially regular intervals therebetween. When the sheet P1 drawn onto the suction belt 10 has been conveyed and the next sheet P2 is drawn onto the suction belt 10, the number of suspended sheets decreases. As a result, the interval between the suspended sheets becomes wider, and an output value of the sheet detection sensor 14 decreases to a value smaller than the threshold β. In response to the decrease in the output value, the bottom plate 15 is lifted. When the bottom plate 15 is lifted slightly, an uppermost sheet of the non-suspended sheet bundle placed on the bottom plate 15 is suspended, by which multiple suspended sheets are pushed up. Thus, the interval between the suspended sheets is returned to a predetermined interval immediately (i.e., the density of the suspended sheets in the sheet suspension zone is returned to the predetermined density). Accordingly, immediately when the next sheet P2 has been conveyed, a further next sheet P3 can be drawn onto the suction belt 10 by the suction force exerted by the suction device 40. Stable conveying capability can be maintained in this manner.

Figure 17:
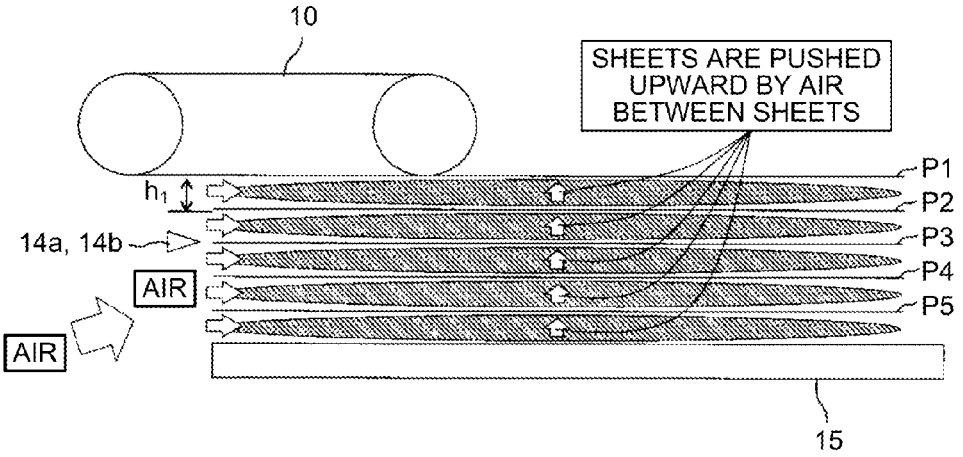
FIG. 17 is a diagram illustrating a state where sheets are suspended when the number of remaining sheets is close to one (in FIG. 17, the number of remaining sheets is five)

FIG. 17 is a diagram illustrating a state where sheets are suspended when the number of remaining sheets is close to one (in the illustrated example, five).

Figure 18:
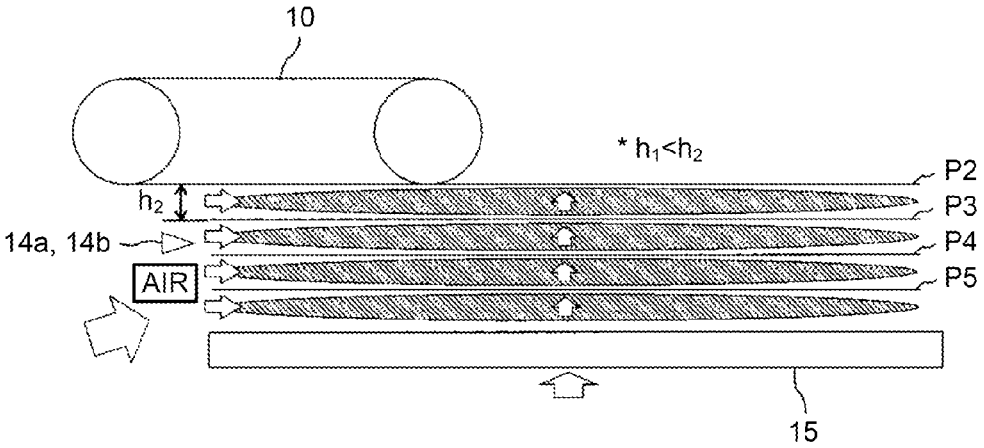
FIG. 18 is a diagram illustrating a state, which follows the state illustrated in FIG. 17, where one of the sheets has been conveyed.
Figure 19:
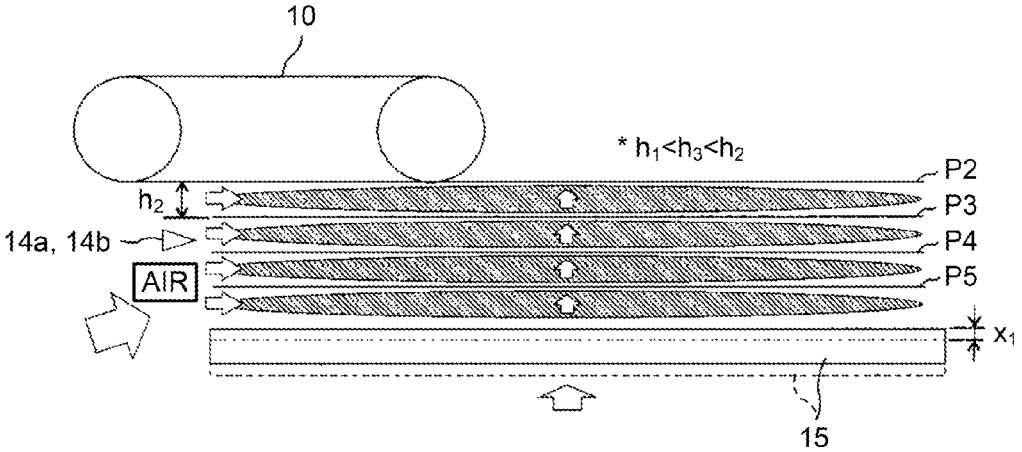
FIG. 19 is a diagram illustrating a state, which follows the state illustrated in FIG. 18, where the bottom plate is lifted X1 mm.

As illustrated in FIG. 17, when the number of remaining sheets placed on the bottom plate 15 is small, no non-suspended sheet bundle is left on the bottom plate 15. When the sheet P1 drawn onto the suction belt 10 as illustrated in FIG. 17 has been conveyed and the next sheet P2 is drawn onto the suction belt 10, the number of suspended sheets in the suspension zone (in this example, the space between the suction belt 10 and the bottom plate 15) becomes four as illustrated in FIG. 18. As a result, the interval of the suspended sheets is widened from h1 to h2, making the density of the suspended sheets in the sheet suspension zone sparse. This change in density decreases an output value of the sheet detection sensor 14 to a value smaller than the threshold β and causes the bottom plate 15 to be lifted a predetermined amount X1 mm (in the embodiment, 1 mm) as illustrated in FIG. 19. As described above, when one or more non-suspended sheets are present on the bottom plate 15, the bottom plate 15 is lifted X1 mm to suspend a non-suspended sheet, thereby pushing up multiple suspended sheets to return the interval between the suspended sheets back to h1. However, when no non-suspended sheet is present on the bottom plate 15, no additional sheet is suspended. Because of not being pushed by a newly suspended sheet, the multiple suspended sheets are pushed only by ascent of the bottom plate 15. However, when the bottom plate 15 is lifted only X1 mm, the suspended sheets are pushed only slightly, and the interval between the suspended sheets does not return to h1 but changes to h3 that is merely slightly smaller than h2, which is the interval between the suspended sheets. In this state, an output value of the sheet detection sensor remains to be smaller than the threshold β. Accordingly, the control operation of lifting the bottom plate 15 X1 mm is performed again. The sequence of lifting the bottom plate 15 the predetermined amount, stopping the bottom plate, and checking an output value of the sheet detection sensor is repeatedly performed until the interval between the suspended sheets reaches h1 and an output value of the sheet detection sensor reaches the threshold β. Repeatedly performing the sequence gradually lifts the bottom plate 15 and changes the interval between the suspended sheets toward h1.

As described above, when the interval between the suspended sheets is wide and therefore the density of the suspended sheets in the sheet suspension zone is low, the suspended sheets are undesirably moved violently in the vertical direction. This can cause an undesirable situation that the sheet P3 does not approach the suction belt 10 and therefore is not drawn onto the suction belt 10 in a period between when the sheet P2 has been conveyed and when the next sheet is to be conveyed, thereby causing sheet feeding failure. Furthermore, in a case where sheets of heavy paper such as thick paper are used, if, after the sheet P2 has been conveyed, an interval between the suction belt 10 and the further next sheet P3 is wider than h1, the suction force exerted by the suction device 40 will be insufficient to suck the sheet P3 onto the suction belt 10. As a result, such an undesirable situation that the sheet P3 is not drawn onto the suction belt 10 before time to convey the sheet comes can occur.

If a long sheet feeding cycle (i.e., wide sheet conveyance intervals) is allowed, there is time to draw a sheet onto the suction belt 10. In that case, the bottom plate 15 can be lifted to a position where an output value of the sheet detection sensor reaches the threshold β, and the sheet P3 can be pushed by the ascent of the bottom plate 15 close to the suction belt. Because the sheet P3 can be drawn onto the suction belt 10 before time to convey a next sheet comes, sheet feeding failure will not occur. However, in a situation where high productivity is desired, the sheet feeding cycle will be inevitably short. This condition results in sheet feeding failure because time to convey a next sheet undesirably comes before the bottom plate 15 is lifted to the position where an output value of the sheet detection sensor reaches the threshold β. At an initial stage after the bottom plate 15 becomes empty of non-suspended sheets, a delay in lifting the bottom plate 15 is small and therefore it is possible that no sheet feeding failure occurs. However, as the number of fed sheets increases, the delay in lifting the bottom plate 15 increases, and the interval between suspended sheets gradually becomes wider. Accordingly, sheet feeding failure can occur after several sheets have been conveyed from when the bottom plate 15 becomes empty of non-suspended sheets.

Figure 20:
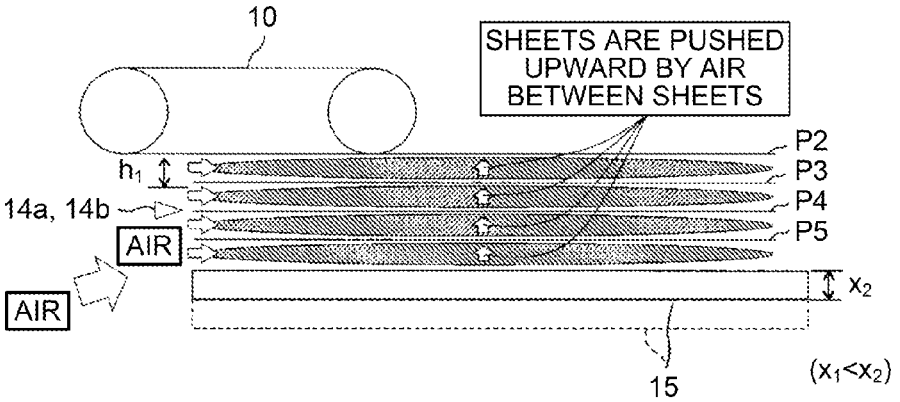
FIG. 20 is a diagram illustrating a state, which follows the state illustrated in FIG. 18, where the bottom plate is lifted X2 mm.

For this reason, the lift amount of the bottom plate 15 may preferably be changed according to the number of remaining sheets in the sheet feeding trays 13. More specifically, as illustrated in FIG. 20, when the number of remaining sheets reaches a value at which the bottom plate 15 becomes empty of non-suspended sheets, the lift amount of the bottom plate 15 is changed from X1 mm to X2 mm (in the embodiment, X2 is twice as large as X1). Changing the lift amount in this manner can lift the bottom plate 15 to the position where the output value of the sheet detection sensor reaches the threshold β before time to convey the next sheet P2 comes as illustrated in FIG. 20. Accordingly, the interval between the suspended sheets can be returned to h1 and therefore the density of the suspended sheets in the sheet suspension zone can be returned to a specified value before the next sheet P2 is conveyed. Thus, even if the number of remaining sheets is small and the sheet feeding cycle is short, a next sheet can be drawn onto the suction belt 10 before time to convey the next sheet comes. If the lift amount of the bottom plate 15 is set to X2 mm in a state where a non-suspended sheet bundle is present on the bottom plate 15, sheets more than the specified number can be suspended. As a result, multiple sheets which are separated insufficiently can be drawn onto the suction belt 10 and cause a multifeed. For this reason, it is desirable not to increase the lift amount of the bottom plate 15 when a non-suspended sheet bundle is present on the bottom plate 15.

Figure 21:
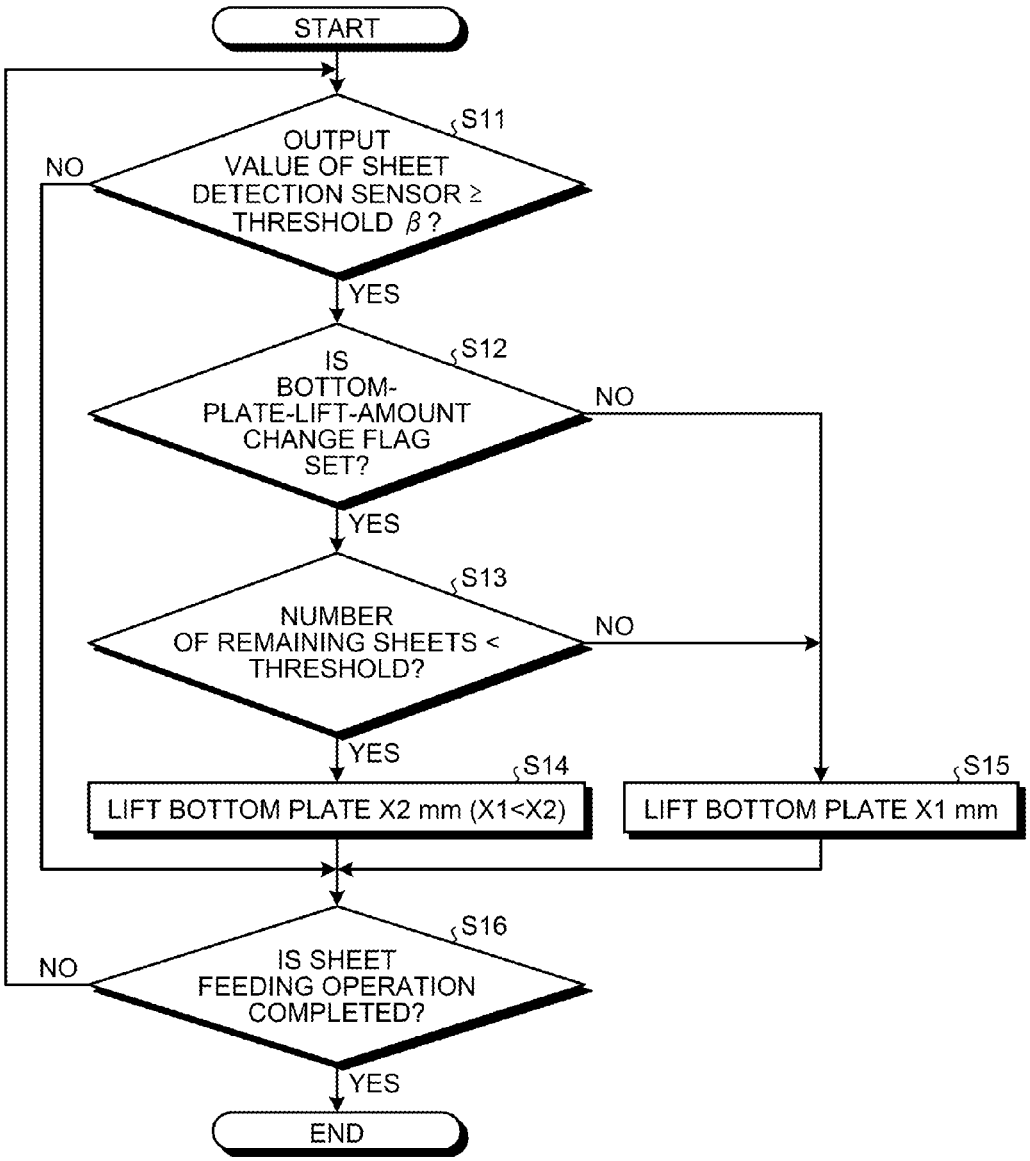
FIG. 21 is a flowchart for bottom-plate lifting control in which control of changing a lift amount of the bottom plate is incorporated.

FIG. 21 is a flowchart for bottom-plate lifting control in which control of changing the lift amount of the bottom plate 15 is incorporated.

As illustrated in FIG. 21, when an output value of the sheet detection sensor is smaller than the threshold β (Yes at S11), whether or not a bottom-plate-lift-amount change flag is set is determined (S12). For example, as described above, how sheets are suspended by air varies greatly depending on the paper type and paper thickness of the sheets. Generally, sheets of light paper such as thin paper are more likely to be suspended, but sheets of heavy paper such as thick paper are less likely to be suspended. Weight of sheets is generally expressed in terms of basis weight. When sheets of light paper such as thin paper having a small basis weight are used, even if, after a sheet drawn onto the suction belt 10 has been conveyed, the suction belt 10 is rather distant from a next sheet, the next sheet can be suspended and drawn onto the suction belt 10 quickly by suction by the suction device 40. The sheet can thus be drawn onto the suction belt 10 before time to convey the next sheet comes. Hence, when sheets of light paper such as thin paper having a small basis weight are used, even if the number of remaining sheets is small, sheet feeding failure will not occur. By contrast, when sheets of heavy paper such as thick paper having a large basis weight are used, the suction force exerted by the suction device 40 can be insufficient to suck a sheet when the sheet moves away from the suction belt 10 even a small distance. Accordingly, in this case, unless the interval between the suspended sheets is narrowed quickly by increasing the lift amount of the bottom plate, sheet feeding failure resulting from a failure in drawing the next sheet onto the suction belt 10 before time to convey the next sheet comes can occur. To prevent such sheet feeding failure, the lift amount of the bottom plate 15 may be changed as follows, for example. When the information about the type of the sheets placed in the sheet feeding tray 13 transmitted from the host controller 67 indicates that the sheets have a predetermined basis weight or larger, the bottom-plate-lift-amount change flag is set, and the lift amount of the bottom plate 15 is changed based on the number of remaining sheets.

As described above, in the embodiment, when sheets placed in the sheet feeding tray 13 are of heavy paper such as thick paper, lifting of the sheet bundle is controlled using the upper sheet detection sensor 14*a*, while when sheets of ordinary paper or lighter paper are used, lifting of the sheet bundle P is controlled using the lower sheet detection sensor 14*b*. Accordingly, the lift amount of the bottom plate 15 may be controlled as follows. When lifting of the sheet bundle is controlled using the upper sheet detection sensor 14*a*, the lift amount of the bottom plate 15 is changed based on the number of remaining sheets. When lifting of the sheet bundle is controlled using the lower sheet detection sensor 14*b*, lift-amount control of the bottom plate 15 based on the number of remaining sheets is not performed.

Whether or not to perform the lift-amount control of the bottom plate 15 based on the number of remaining sheets may preferably be determined according to the sheet detection sensor to be used, so that even if, for example, the sheet detection sensor to be used is switched by hardware such as a switch rather than by software, whether or not to perform the lift-amount control of the bottom plate 15 based on the number of remaining sheets can be determined according to the sheet detection sensor that is used after the switching.

A configuration in which whether or not to perform the lift-amount control of the bottom plate 15 based on the number of remaining sheets is user-configurable by operating the operating unit 124 of the image forming apparatus 100 or the like may be employed. More specifically, there can be a case where even if sheets of paper lighter than the predetermined basis weight are used, sheet feeding failure actually occurs due to various conditions such as an environment when the number of remaining sheets is close to one. In such a case, a user can operate the operating unit 124 to configure settings so that the lift-amount control of the bottom plate 15 based on the number of remaining sheets is performed. When the user has operated the operating unit 124 to configure the settings so that the lift-amount control of the bottom plate 15 based on the number of remaining sheets is performed, the control unit 66 sets the bottom-plate-lift-amount change flag.

If the bottom-plate-lift-amount change flag is not set (No at S12), the lift-amount control of the bottom plate based on the number of remaining sheets is not performed, but the bottom plate 15 is lifted X1 mm (in the embodiment, 1 mm). On the other hand, if the bottom-plate-lift-amount change flag is set (Yes at S12), the lift-amount control of the bottom plate based on the number of remaining sheets is performed. More specifically, if the bottom-plate-lift-amount change flag is set (Yes at S12), whether or not the number of remaining sheets is smaller than a threshold is determined (S13).

Whether or not the number of remaining sheets is smaller than the threshold is detectable based on a vertical position of the bottom plate 15. For example, when a stepping motor is used as the lifting/lowering drive motor 65 (see FIG. 7) which lifts and lowers the bottom plate 15, the control unit 66 can detect the vertical position as follows. The control unit 66 adds up the number of feed pulses and detects that the vertical position of the bottom plate 15 has reached a position where the number of remaining sheets is smaller than the threshold when the total of the number of feed pulses obtained by the addition becomes equal to or larger than a threshold. When a DC motor is used as the lifting/lowering drive motor 65 (see FIG. 7), the control unit 66 can detect the vertical position as follows. The control unit 66 adds up run time of the DC motor and detects that the vertical position of the bottom plate 15 has reached the position where the number of remaining sheets is smaller than the threshold when the total run time obtained by the addition becomes equal to or larger than a threshold. The control unit 66 functions as a remaining-sheet-amount detecting unit in this manner. Alternatively, the control unit 66 may detect that the vertical position of the bottom plate 15 has reached the position where the number of remaining sheets is smaller than the threshold using a sensor such as an optical sensor. Further alternatively, the control unit 66 may count the number of sheets that are fed after it is detected using a sensor that the bottom plate 15 has ascended to a predetermined position, and detect that the number of remaining sheets has decreased to a value smaller than the threshold when the number of fed sheets exceeds a threshold. In the embodiment, the threshold for the number of remaining sheets is set to the number of remaining sheets at which the bottom plate becomes empty of non-suspended sheets. Alternatively, the threshold may be set to the number of remaining sheets in a state where several sheets have been conveyed after the bottom plate becomes empty of non-suspended sheets.

When the number of remaining sheets is equal to or larger than the threshold and one or more non-suspended sheets are present on the bottom plate 15 (No at S13), lifting the bottom plate 15 a small amount causes a non-suspended sheet to be suspended. The non-suspended sheet pushes up suspended sheets, thereby making it possible to draw a sheet onto the suction belt 10 before time to convey the next sheet comes. However, if the bottom plate 15 is lifted a large amount with one or more non-suspended sheets on the bottom plate 15, the number of suspended sheets increases. In this case, insufficient separation of sheets can cause a multifeed. For this reason, when the number of remaining sheets is equal to or larger than the threshold and one or more non-suspended sheets are present on the bottom plate 15 (No at S13), the bottom plate 15 is lifted a small amount, or X1 mm (in the embodiment, 1 mm) (S15).

On the other hand, if the number of remaining sheets is smaller than the threshold (Yes at S13), the lift amount of the bottom plate 15 is increased by setting the lift amount to twice (2 mm) the normal lift amount X1 (1 mm). As a result, because the distance the suspended sheets are pushed by the ascent of the bottom plate 15 increases as compared with the case where the lift amount is X1 mm, an uppermost suspended sheet of the multiple suspended sheets can be brought close to the suction belt 10. As a result, the uppermost sheet can be favorably sucked to the suction belt 10 by the suction force exerted by the suction device 40, and the sheet can be drawn onto the suction belt 10 before time to convey the sheet comes. Hence, sheet feeding failure which can occur when the number of remaining sheets is small can be reduced.

The lift amount of the bottom plate 15 can be controlled by, if a stepping motor is used as the lifting/lowering drive motor 65 (see FIG. 7), making use of the number of feed pulses of the stepping motor. When a DC motor is used as the lifting/lowering drive motor 65, the lift amount can be controlled using an encoder.

A configuration in which the lift amount X2 mm of the bottom plate 15 in a state where the number of remaining sheets is smaller than the threshold is user-adjustable may be employed. More specifically, for example, sheets having a considerably large basis weight are suspended gradually rather than immediately after the bottom plate 15 is lifted. Put another way, sheets having a considerably large basis weight have a large time lag between when the bottom plate 15 is lifted and when the sheets are suspended. In addition, the suction force of the suction device 40 does not act sufficiently unless the sheets are considerably close to the suction belt. Accordingly, when such sheets of considerably heavy paper having a considerably large basis weight are used, sheet feeding failure can occur even if the lift amount of the bottom plate 15 in a state where the number of remaining sheets is smaller than the threshold is set to X2 mm. In such a case, a user can operate the operating unit 124 to set the lift amount to a value still larger than X2 mm. By setting the lift amount to such a value, occurrence of sheet feeding failure in a state where the number of remaining sheets is close to one can be prevented, or at least reduced, even if sheets of considerably heavy paper having a considerably large basis weight are placed in the sheet feeding tray 13.

As described above, at an initial stage after the bottom plate 15 becomes empty of non-suspended sheets, a delay in lifting the bottom plate 15 is small and therefore it is possible that no sheet feeding failure occurs. However, the interval between suspended sheets becomes wider with the number of fed sheets. For this reason, the lift amount of the bottom plate 15 may preferably be switched stepwise with multiple steps. For example, the lift amount of the bottom plate 15 may be increased each time a sheet is fed after the number of remaining sheets has reached the threshold. By increasing the lift amount in this manner, sheet feeding failure which can occur when the number of remaining sheets is close to one can be further reduced.

The example configurations described above are merely exemplary, and the present invention provides advantage(s) specific to each of the following aspects.

According to a first aspect, the sheet feeding device 200 includes a sheet stacking member, such as the bottom plate 15, on which the sheet bundle P is to be placed, an air blowing unit, such as the air blowing device 22, configured to blow air onto the sheet bundle P placed on the sheet stacking member to suspend multiple sheets of a top portion of the sheet bundle P, a lifting/lowering unit, such as the lifting/lowering drive motor 65, configured to lift/lower the sheet stacking member, an optical reflection sensor, such as the sheet detection sensor, configured to detect a suspended sheet suspended by the air blowing unit, and a control unit, such as the control unit 66, configured to control the lifting/lowering unit based on an output value of the optical reflection sensor. The optical reflection sensor is configured to be capable of detecting an area corresponding to multiple sheets in a sheet suspension zone extending between a non-suspended sheet bundle which is made up of sheets not suspended during a period when air is blown by the air blowing unit and a conveying member, such as the suction belt, configured to convey an uppermost sheet of the multiple suspended sheets.

The applicant conducted extensive studies about the reason why a control operation of lifting the sheet stacking member when the optical reflection sensor detects absence of a sheet and stopping lifting the sheet stacking member when the optical reflection sensor detects presence of a sheet causes the following disadvantages. The disadvantages are, more specifically, that the sheet bundle excessively approaches the suction belt and frequency of multifeeds is increased and that that the sheet bundle is excessively separated from the suction belt and sheet feeding capability is decreased. The studies reveal that the following is a cause of the disadvantages. In a conventional optical reflection sensor, light emitted from a light-emitting element is converged through a condenser lens to a predetermined position on a side surface of the sheet bundle at a leading end in a sheet-bundle moving direction. The predetermined position is a sheet feeding position where an uppermost sheet of the sheet bundle is to be positioned when the air blowing unit blows air to suspend sheets of a top portion of the sheet bundle. The conventional optical reflection sensor is configured to detect "presence" or "absence" of a sheet at the sheet feeding position by converging light from the light-emitting element to the sheet feeding position through the condenser lens and defining an area corresponding to no more than one sheet in the vertical direction with reference to the sheet feeding position as a detection area of the optical reflection sensor.

When the multiple sheets of the top portion of the sheet bundle are suspended by directing air toward side faces of the top portion of the sheet bundle in three directions (a front face and both side faces in a width direction of the sheet bundle), the suspended sheets behave unstably, causing an suspended sheet to stay or not to stay at the sheet feeding position. Thus, when the optical reflection sensor configured to detect presence/absence of a sheet at the sheet feeding position is used, if the suspended sheet is brought out of the sheet feeding position by unstable behavior of the suspended sheets, the sensor detects that a sheet is absent. As a result, the non-suspended sheet bundle is lifted. When the non-suspended sheet bundle is lifted, a top portion of the non-suspended sheet bundle enters an area against which air is directed by the air blowing unit, and a sheet is suspended. As a result, the number of the suspended sheets increases, and the density of the suspended sheets in the sheet suspension zone increases (i.e., the suspended sheets become dense in the zone). In this state, flows of air produced by the air blowing unit in the suspension zone are insufficient to move the suspended sheets in the vertical direction sufficiently (i.e., the sheets are separated insufficiently). As a result, multiple sheets are drawn onto the suction belt, resulting in a multifeed. Furthermore, if a suspended sheet remains in the sheet feeding position for a predetermined period of time even after the uppermost sheet of the multiple suspended sheets has been conveyed, the optical reflection sensor detects that a sheet is present, and the non-suspended sheet bundle is lifted later than predetermined timing. As a result, the number of the suspended sheets decreases, and the density of the sheets in the sheet suspension zone decreases (i.e., the suspended sheets become sparse in the zone). When the suspended sheets are "sparsely" present, motion of the suspended sheets in the vertical becomes violent. As a result, an undesirable situation that the uppermost sheet of the multiple suspended sheets does not approach the suction belt 10 and is not drawn onto the suction belt before time to convey the next sheet comes can occur. Consequently, sheet feeding failure will occur.

As described above, the studies reveal that the conventional optical reflection sensor configured to detect presence/absence of a sheet at the sheet feeding position is disadvantageously incapable of detecting the density of suspended sheets (more specifically, whether or not the suspended sheets are dense or sparse) in the sheet suspension zone. This disadvantage increases the number of suspended sheets larger than the number of sheets (hereinafter, "the specified number of sheets") at which sheets can be separated favorably, thereby causing a multifeed, or prolongs the period during which the number of suspended sheets is smaller than the specified number, thereby causing sheet feeding failure.

In the light of this, in the first aspect, the detection area is extended in the sheet-bundle lifting/lowering direction larger than that of the conventional optical sensor. More specifically, the optical reflection sensor is configured to be capable of detecting the area corresponding to multiple sheets in the sheet suspension zone. This allows detection of intensity of light reflected from the predetermined area in the sheet suspension zone. The light-emitting element of the optical reflection sensor receives light reflected from a leading-end surface(s) of a sheet(s) and outputs a voltage which depends on an amount of the received light. Accordingly, when the suspended sheets are dense in the sheet suspension zone, the number of suspended sheets in the detection area of the optical reflection sensor is large, and an output of the optical reflection sensor is high. On the other hand, when the suspended sheets are sparse in the sheet suspension zone, the number of suspended sheets in the detection area of the optical reflection sensor is small, and an output of the optical reflection sensor is low. Hence, the density of suspended sheets (more specifically, whether or not the suspended sheets are dense or sparse) in the sheet suspension zone is optically detectable from an output value of the optical reflection sensor. So long as the number of suspended sheets is the specified number at which sheets can be separated favorably, the density of the sheets in the detection area of the optical reflection sensor is constant even if the suspended sheets behave slightly unstably, and the optical reflection sensor outputs the preset value. When the uppermost sheet of the multiple suspended sheets has been conveyed by the suction belt and the number of the suspended sheets is decreased, the density of the sheets in the detection area of the optical reflection sensor decreases. As a result, an output value of the optical reflection sensor decreases to a value smaller than the preset value. However, at this time, by performing the control operation of lifting the sheet stacking member to ascend the sheet bundle, the uppermost sheet of the sheet bundle can be suspended with air blown by the air blowing unit, so that the specified number of suspended sheets is suspended. Thus, the number of the suspended sheets is adjustable to the specified number by lifting the sheet bundle when the number of suspended sheets has decreased to a number smaller than the specified number.

As described above, according to the first aspect, the optical reflection sensor is configured to be capable of detecting the area corresponding to multiple sheets in the sheet suspension zone. Because lifting of the sheet bundle can be controlled so as to keep the number of suspended sheets at the specified number, a multifeed which can occur when suspended sheets in the sheet suspension zone become dense as a result of lifting a non-suspended sheet bundle an excessively large amount can be prevented, or at least reduced. Furthermore, sheet feeding failure which occurs in the following manner can be prevented, or at least reduced. That is, a delay in lifting the non-suspended sheet bundle prolongs the period during which the suspended sheets are sparse in the sheet suspension zone. As a result, an uppermost sheet of the suspended sheets is not drawn onto the suction belt even when time to convey the sheet comes, resulting in sheet feeding failure.

Furthermore, according to the first aspect, even when unstable behavior of the suspended sheets slightly varies depending on sheet conditions including an usage environment and a sheet type, the density of the sheets in the detection area of the optical reflection sensor remains substantially constant, and therefore the optical reflection sensor can output the preset value. Accordingly, the need of determining a preset value for each of the sheet conditions including usage environments and sheet types in advance is eliminated. Furthermore, the need of making the assessment in advance is eliminated. Accordingly, an increase in manufacturing cost can be reduced as compared with the configuration disclosed in Japanese Laid-open Patent Application No. 2010-120721 which requires assessment of each of the sheet conditions including the usage environments and the sheet types in advance. Furthermore, an increase in capacity of a memory where the preset values are to be stored can be reduced. Furthermore, because the need of providing a detecting unit(s) for detecting the usage environment, the sheet type, and the like is eliminated, an increase in the number of parts can be reduced, and therefore an increase in cost of the device can be reduced.

According to a second aspect, in the sheet feeding device according to the first aspect, the control unit, such as the control unit 66, controls the lifting/lowering unit, such as the lifting/lowering drive motor 65, so as to lift the sheet stacking member, such as the bottom plate 15, when the output value of the optical reflection sensor, such as the sheet detection sensor, is smaller than the threshold β.

Controlling the lifting/lowering unit in this manner allows, as described in the embodiment, a fixed number of sheets can be suspended between the suction belt 10 and the sheet bundle, thereby reducing sheet feeding failure.

According to a third aspect, in the sheet feeding device according to the first or second aspect, the detection area extends to have a vertical length corresponding to multiple sheets of the sheet bundle at least above a sheet feeding position where the uppermost sheet of the sheet bundle is to be positioned when the air blowing unit starts air blowing.

This allows detection of whether or not the sheet bundle is at the sheet feeding position from an output value of the optical reflection sensor. Accordingly, cost of the device can be reduced as compared with a configuration which includes a sensor for detecting a condition of suspended sheets and a sensor for detecting arrival of a top surface of the sheet bundle, against which air is not blown yet, at the sheet feeding position.

According to a fourth aspect, in the sheet feeding device according to the third aspect, the sheet feeding position is changed depending on a type of the sheets.

If sheets of heavy paper such as thick paper are placed on the sheet stacking member, such as the bottom plate 15, a suction force of the air blowing device 22 and the suction device 40 may be insufficient to lift one of the sheets and, as a result, a failure in sucking the sheet onto the suction belt 10 can occur. Whether or not a sheet can be sufficiently lifted by the air blowing device 22 and the suction device 40 and whether or not the sheet can be drawn onto the suction belt vary depending on the type of the sheet in this manner. Accordingly, by changing a sheet-feedable position depending on the sheet type, drawing a sheet onto the suction belt 10 can be favorably achieved.

According to a fifth aspect, in the sheet feeding device according to the fourth aspect, the optical reflection sensor includes multiple optical reflection sensors which are identical in characteristics and arranged in the lifting/lowering direction of the sheet bundle.

This makes the sheet feeding position of the sheets variable.

According to a sixth aspect, in the sheet feeding device according to the fifth aspect, the multiple optical reflection sensors are attached to the same fixing member 140. This structure allows reduction of the number of parts as compared with a structure in which the optical reflection sensors are attached to respective different fixing members, thereby reducing cost of the sheet feeding device.

According to a seventh aspect, in the sheet feeding device according to the sixth aspect, the fixing member 140 includes an adjusting unit, such as the elongated hole 140*a*, configured to allow adjustment of a mount position where the fixing member 140 is attached to a device body in the lifting/lowering direction of the sheet bundle.

This structure allows, as described above in the embodiment, fine adjustment of a detection position of the optical reflection sensor, such as the sheet detection sensor 14, attached to the fixing member 140 in the lifting/lowering direction of the sheet bundle by adjusting the position where the fixing member 140 is attached to the device body in the lifting/lowering direction of the sheet bundle.

According to an eighth aspect, the sheet feeding device according to any one of the first to seventh aspects further includes a number-of-remaining-sheets detecting unit, such as the control unit 66, configured to detect the number of remaining sheets placed on the sheet stacking member and a lift-amount change unit, such as the control unit 66. The control unit, such as the control unit 66, controls the lifting/lowering unit, such as the lifting/lowering drive motor 65, so as to lift the sheet stacking member a predetermined amount when the output value of the optical reflection sensor is smaller than the threshold. The lift-amount change unit changes a lift amount, which is the amount the sheet stacking member is to be lifted when the output value of the optical reflection sensor is smaller than the threshold, based on a detection result output from the number-of-remaining-sheets detecting unit.

This can prevent, or at least reduce, occurrence of sheet feeding failure as described above with reference to FIGS. 20 and 21 and the like.

According to a ninth aspect, in the sheet feeding device according to the eighth aspect, the lift-amount change unit, such as the control unit 66, increases the lift amount of the sheet stacking member, such as the bottom plate 15, when the number of remaining sheets detected by the number-of-remaining-sheets detecting unit, such as the control unit 66, is smaller than a threshold.

According to this, as described above with reference to FIGS. 20 and 21 and the like, even if the number of remaining sheets is smaller than the threshold and no sheet is on the sheet stacking member when multiple sheets are suspended by air blown against the sheet bundle P placed on the sheet stacking member, such as the bottom plate 15, the suspended sheets can be pushed up sufficiently by an ascent of the sheet stacking member, such as the bottom plate 15. This prevents, or at least makes it difficult, an uppermost sheet of the multiple suspended sheets from becoming too distant from the conveying member, such as the suction belt 10. As a result, because the uppermost sheet can be positioned in an area where the suction force exerted by a suction unit, such as the suction device 40, acts sufficiently after a sheet drawn onto the conveying member has been conveyed, the uppermost sheet can be drawn onto the conveying member before time to convey the next sheet comes. Therefore, even if there is no non-suspended sheet on the sheet stacking member, such as the bottom plate 15, sheet conveyance can be performed favorably without causing sheet feeding failure.

According to a tenth aspect, in the sheet feeding device according to the eighth or ninth aspect, the lift-amount change unit, such as the control unit 66, changes the lift amount of the sheet stacking member, such as the bottom plate 15, based on the detection result output from the number-of-remaining-sheets detecting unit, such as the control unit 66, when a basis weight of the sheets placed on the sheet stacking member is equal to or larger than a threshold.

As described above with reference to FIG. 21, a sheet having a large basis weight is less likely sucked by a suction force exerted by the suction device 40 or the like than a sheet having a small basis weight. The suction force exerted by the suction unit decreases with the distance from the suction unit. Accordingly, if a heavy sheet having a large basis weight is away from the conveying member, the sheet cannot be sucked onto the conveying member, such as the suction belt 10, by the suction force of the suction unit. Thus, a sheet having a large basis weight can more easily cause sheet feeding failure than a sheet having a small basis weight. In the light of this, by increasing the lift amount of the bottom plate 15 when the number of remaining sheets has become small (more specifically, when the number of remaining sheets reaches a number at which the bottom plate 15 becomes empty of non-suspended sheets) in a situation where heavy sheets having a large basis weight are used, an uppermost suspended sheet can be brought close to the conveying member. Even when heavy paper having a large basis weight is used, by moving an uppermost sheet to the conveying member by the suction force exerted by the suction unit in this manner, the sheet can be drawn onto the conveying member before time to convey the next sheet comes. Hence, sheet feeding failure can be reduced even when the number of remaining sheets of heavy paper having a large basis weight is close to one.

According to an eleventh aspect, in the sheet feeding device according to the tenth aspect, the optical reflection sensor, such as the sheet detection sensor, includes multiple optical reflection sensors which are identical in characteristics and arranged in the lifting/lowering direction of the sheet bundle. Which of the optical reflection sensors is used is changed depending on the basis weight of the sheets placed on the sheet stacking member. The lift-amount change unit changes the lift amount of the sheet stacking member, such as the bottom plate 15, based on the detection result output from the number-of-remaining-sheets detecting unit when a predetermined optical reflection sensor is used.

According to the eleventh aspect, as described above in the embodiment, whether or not to change the lift amount of the sheet stacking member, such as the bottom plate 15, based on the detection result output from the number-of-remaining-sheets detecting unit can be determined according to which of the optical reflection sensors is used. Accordingly, the need of determining whether or not to change the lift amount of the sheet stacking member, such as the bottom plate 15, based on the detection result output from the number-of-remaining-sheets detecting unit depending directly on the basis weight of the sheets placed on the sheet stacking member, such as the bottom plate 15, is eliminated.

According to a twelfth aspect, in the sheet feeding device according to the tenth or eleventh aspect, whether to perform the lift-amount change unit is user-configurable.

According to this, as described above in the embodiment, in an occasion where although the basis weight of the sheets is equal to or smaller than a threshold, sheet feeding failure occurs due to various conditions such as an environment when the number of remaining sheets is close to one, the lift-amount change can be performed in accordance with user's operation. According to this, the lift amount of the sheet stacking member, such as the bottom plate 15, can be increased, thereby preventing, or at least reducing, sheet feeding failure which can occur when the number of remaining sheets is close to one.

According to a thirteenth aspect, in the sheet feeding device according to any one of the eighth to twelfth aspects, the lift amount to be changed by the light-amount change unit is user-configurable.

According to this, as described above in the embodiment, in an occasion where sheet feeding failure occurs as in a case where, for example, sheets of considerably heavy paper having a considerably large basis weight are used and when the number of remaining sheets is close to one, a user can perform configuration according to which the lift amount of the bottom plate is increased. This can, even if sheets of considerably heavy paper having a considerably large basis weight are used, prevent, or at least reduce, occurrence of sheet feeding failure in a state where the number of remaining sheets is close to one.

According to a fourteenth aspect, in the sheet feeding device according to the eighth aspect, the lift-amount change unit changes the lift amount stepwise with multiple steps based on the detection result output from the number-of-remaining-sheets detecting unit.

As described above in the embodiment, a delay in lifting the sheet stacking member, such as the bottom plate 15, gradually increases and the gap between the suction belt and the uppermost suspended sheet gradually increases every time a sheet is conveyed. Accordingly, sheet feeding failure can be favorably prevented, or at least reduced, by increasing the lift amount of the sheet stacking member stepwise with the decrease in the number of remaining sheets.

According to a fifteenth aspect, in an image forming apparatus including an image forming unit, such as the image forming apparatus 100, configured to form an image on a sheet, and a sheet feeding unit, such as the sheet feeding device 200, configured to feed a sheet to the image forming unit, the sheet feeding device according to any one of first to fourteenth aspects is used as the sheet feeding unit.

This can reduce sheet feeding failure and occurrence of paper jam.

According to a sixteenth aspect, in the image forming system 1 including the image forming apparatus 100 which includes an image forming unit configured to form an image on a sheet, and the sheet feeding device 200 configured to feed a sheet to the image forming apparatus 100, the sheet feeding device according to any one of first to fourteenth aspects is used as the sheet feeding device.

This can provide an image forming system capable of reducing sheet feeding failure and reducing occurrence of paper jam.

According to an aspect of the present invention, a sheet feeding device, an image forming apparatus and an image forming system capable of reducing sheet feeding failure while reducing an increase in manufacturing cost and cost of the device are provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet feeding device comprising:

a sheet stacking member on which a sheet bundle is to be placed;

an air blower configured to blow air against a leading end and side surfaces of a top portion of the sheet bundle placed on the sheet stacking member to suspend multiple sheets of the top portion of the sheet bundle;

a lifting/lowering drive motor configured to lift/lower the sheet stacking member;

multiple optical reflection sensors configured to detect a suspended sheet suspended by the air blower; and a controller configured to control the lifting/lowering drive motor based on an output value of the multiple optical reflection sensors, wherein the multiple optical reflection sensors are configured to be capable of detecting an area corresponding to multiple sheets in a sheet suspension zone extending between a non-suspended sheet bundle and a conveying member, the non-suspended sheet bundle being made up of sheets not suspended during a period when air is blown by the air blower, the conveying member being configured to convey an uppermost sheet of the multiple suspended sheets, and wherein the controller determines which one of the multiple optical reflection sensors is to be used based on a type of sheet placed in the sheet stacking member.

2. The sheet feeding device according to claim 1, wherein the controller controls the lifting/lowering drive motor so as to lift the sheet stacking member when the output value of one of the multiple optical reflection sensors is smaller than a threshold.

3. The sheet feeding device according to claim 1, wherein the detection area extends to have a vertical length corresponding to multiple sheets of the sheet bundle at least above a sheet feeding position where the uppermost sheet of the sheet bundle is to be positioned when the air blower starts air blowing.

4. The sheet feeding device according to claim 3, wherein the sheet feeding position is changed depending on a type of the sheets.

5. The sheet feeding device according to claim 4, wherein the multiple optical reflection sensors are identical in characteristics and arranged in a lifting/lowering direction of the sheet bundle.

6. The sheet feeding device according to claim 5, wherein the multiple optical reflection sensors are attached to a same fixing member.

7. The sheet feeding device according to claim 6, wherein the fixing member includes an adjusting member configured to allow adjustment of a mount position where the fixing member is attached to a device body in the lifting/lowering direction of the sheet bundle.

8. The sheet feeding device according to claim 1, further comprising:

a number-of-remaining-sheets detector configured to detect number of remaining sheets placed on the sheet stacking member; and a lift-amount change member, wherein the controller is configured to control the lifting/lowering member so as to lift the sheet stacking member a set amount when the output value of the multiple optical reflection sensors is smaller than the threshold, and the lift-amount change member configured to change a lift amount based on a detection result output from the number-of-remaining-sheets detector, the lift amount being an amount the sheet stacking member is to be lifted when the output value of the multiple optical reflection sensors are smaller than the threshold.

9. The sheet feeding device according to claim 8, wherein the lift-amount change member increases the lift amount of the sheet stacking member when the number of remaining sheets detected by the number-of-remaining-sheets detector is smaller than a threshold.

10. The sheet feeding device according to claim 8, wherein the lift-amount change member changes the lift amount of the sheet stacking member based on the detection result output from the number-of-remaining-sheets detector when a basis weight of the sheets placed on the sheet stacking member is equal to or larger than a threshold.

11. The sheet feeding device according to claim 10, wherein the multiple optical reflection sensors are identical in characteristics and arranged in a lifting/lowering direction of the sheet bundle, one of the multiple optical reflection sensors is used depending on the basis weight of the sheets placed on the sheet stacking member, and the lift-amount change member changes the lift amount of the sheet stacking member based on the detection result output from the number-of-remaining-sheets detector when a set optical reflection sensor is used.

12. The sheet feeding device according to claim 10, wherein whether to perform lift-amount change is user-configurable.

13. The sheet feeding device according to claim 8, wherein the lift amount to be changed by the light-amount change member is user-configurable.

14. The sheet feeding device according to claim 8, wherein the lift-amount change member changes the lift amount of the sheet stacking member stepwise with multiple steps based on the detection result output from the number-of-remaining-sheets detector.

15. An image forming apparatus comprising:

an image forming unit configured to form an image on a sheet; and a sheet feeding unit configured to feed a sheet to the image forming unit, wherein the sheet feeding device according to claim 1 is used as the sheet feeding unit.

16. An image forming system comprising:

an image forming apparatus including an image forming unit configured to form an image on a sheet; and a sheet feeding device configured to feed a sheet to the image forming apparatus, wherein the sheet feeding device according to claim 1 is used as the sheet feeding device.

17. The sheet feeding device according to claim 1, wherein the air blower includes:

a front duct to blow air against a downstream end in a sheet feeding direction of the top portion of the sheet bundle; and a pair of side ducts arranged in a pair of side fences to blow air against side surfaces of the top portion of the sheet bundle.

18. The sheet feeding device according to claim 17, wherein the air blower supplies air into the front duct and the pair of side ducts using a blower fan.

19. The sheet feeding device according to claim 1, wherein the multiple optical reflection sensors are arranged on top of each other.

20. The sheet feeding device according to claim 19, wherein an upper optical reflection sensor controls the lifting of the sheet bundle when the sheet is a thick paper, and a lower optical reflection sensor controls the lifting of the sheet bundle when the sheet is a thin paper.

* * * * *